US009495867B2

(12) United States Patent
Korenaga et al.

(10) Patent No.: US 9,495,867 B2
(45) Date of Patent: Nov. 15, 2016

(54) TRAFFIC INFORMATION PROCESSING SYSTEM, SERVER DEVICE, TRAFFIC INFORMATION PROCESSING METHOD, AND PROGRAM

(71) Applicant: MITSUBISHI HEAVY INDUSTRIES, LTD., Tokyo (JP)

(72) Inventors: Takeshi Korenaga, Tokyo (JP); Hisaji Takeuchi, Tokyo (JP); Ryota Hiura, Tokyo (JP); Tomohiro Murata, Tokyo (JP); Takeshi Nagata, Tokyo (JP); Hiromichi Nakamoto, Tokyo (JP); Seiki Kato, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 14/646,184

(22) PCT Filed: Nov. 21, 2013

(86) PCT No.: PCT/JP2013/081382
§ 371 (c)(1),
(2) Date: May 20, 2015

(87) PCT Pub. No.: WO2014/080978
PCT Pub. Date: May 30, 2014

(65) Prior Publication Data

US 2015/0294563 A1 Oct. 15, 2015

(30) Foreign Application Priority Data

Nov. 22, 2012 (JP) ..... 2012-256519

(51) Int. Cl.
*G08G 1/01* (2006.01)

(52) U.S. Cl.
CPC ..... *G08G 1/0112* (2013.01); *G08G 1/0116* (2013.01); *G08G 1/0125* (2013.01); *G08G 1/0133* (2013.01); *G08G 1/0141* (2013.01)

(58) Field of Classification Search
CPC ..... G08G 1/0116; G08G 1/0133; G08G 1/0112; G08G 1/0125; G08G 1/0141; G08G 1/04; G08G 1/13; G01C 21/26
USPC ..... 701/117, 118
See application file for complete search history.

(56) References Cited

U.S. PATENT DOCUMENTS 6,810,321 B1 * 10/2004 Cook ..... G08G 1/0104 340/905
7,570,158 B2 8/2009 Denny et al.
(Continued)

FOREIGN PATENT DOCUMENTS

CN 101154317 A 4/2008
CN 101354837 A 1/2009
(Continued)

OTHER PUBLICATIONS

International Search Report mailed Jan. 14, 2014, corresponding to International patent application No. PCT/JP2013/081382.
(Continued)

*Primary Examiner* — Atul Trivedi
(74) *Attorney, Agent, or Firm* — Kanesaka Berner & Partners, LLP

(57) ABSTRACT

A traffic information processing system includes on-board unit configured to be installed in a vehicle, an on-board unit-equipped vehicle number-detecting unit configured to detect the number of vehicles equipped with on-board unit entering a sample area based on information received from the on-board unit, a total vehicle number-detecting unit configured to detect the number of all vehicles entering the sample area, a vehicle ratio operation unit configured to calculate a value related to a ratio based on the number of vehicles equipped with the on-board unit detected by the on-board unit-equipped vehicle number-detecting unit and the number of all vehicles detected by the total vehicle number-detecting unit, and a total vehicle number-estimating operation unit configured to calculate a total number of vehicles in the zone.

10 Claims, 24 Drawing Sheets

(56) References Cited

U.S. PATENT DOCUMENTS

| | | | | |
|---|---|---|---|---|
| 8,935,268 | B2 * | 1/2015 | Uramoto | H04W 4/021 701/408 |
| 2004/0046019 | A1 * | 3/2004 | Kojima | G07B 15/063 235/384 |
| 2004/0203577 | A1 * | 10/2004 | Forman | B60R 25/1003 455/404.2 |
| 2006/0082472 | A1 * | 4/2006 | Adachi | G08G 1/096716 340/995.13 |
| 2006/0247846 | A1 * | 11/2006 | Cera | G08G 1/13 701/118 |
| 2008/0042825 | A1 * | 2/2008 | Denny | G08G 1/205 340/522 |
| 2008/0046165 | A1 * | 2/2008 | Downs | G08G 1/0104 701/117 |
| 2008/0071465 | A1 * | 3/2008 | Chapman | G01C 21/3691 701/117 |
| 2009/0325612 | A1 * | 12/2009 | Oesterling | H04W 4/14 455/466 |
| 2009/0326994 | A1 * | 12/2009 | Petroczi | G08G 1/207 705/13 |
| 2010/0057592 | A1 * | 3/2010 | Moir | G01G 23/3735 705/29 |
| 2010/0070128 | A1 * | 3/2010 | Johnson | G08G 1/096783 701/31.4 |
| 2011/0163895 | A1 * | 7/2011 | Rado | G01S 5/0294 340/933 |
| 2014/0132425 | A1 * | 5/2014 | Buckel | G08G 1/08 340/933 |

FOREIGN PATENT DOCUMENTS

| | | | |
|---|---|---|---|
| CN | 102314768 | A | 1/2012 |
| JP | 2004-318621 | A | 11/2004 |
| JP | 3832448 | B2 | 10/2006 |
| JP | 2007-257421 | A | 10/2007 |
| JP | 2008-210123 | A | 9/2008 |
| JP | 2010-61435 | A | 3/2010 |
| JP | 2011-70574 | A | 4/2011 |
| JP | 2012-84024 | A | 4/2012 |
| JP | 2012-194761 | A | 10/2012 |
| WO | 2012/058968 | A1 | 5/2012 |

OTHER PUBLICATIONS

Written Opinion mailed Jan. 14, 2014, corresponding to International patent application No. PCT/JP2013/081382.

Office Action in CN Application No: 201380060931.4, mailed Mar. 11, 2016.

Office Action in KR Application No: 10-2015-7013169, mailed Sep. 2, 2016.

* cited by examiner

| ON-BOARD UNIT ID | 12340001 | 12340008 | · · · |
|---|---|---|---|
| TIME | 9:01 | 9:07 | |

| START TIME | 9:00 | 9:30 | · · · |
|---|---|---|---|
| END TIME | 9:10 | 9:40 | |
| FILE NAME | MOVING IMAGE 1 | MOVING IMAGE 2 | |

| ON-BOARD UNIT ID | ENTERING TIME | LEAVING TIME | PRESENCE DETECTION |
|---|---|---|---|
| 123400001 | 10:05 | 10:10 | – |
| 123400002 | 10:06 | 10:11 | – |
| 123400003 | 10:06 | 10:12 | – |
| 123400004 | 10:06 | – | ○ |

*FIG. 16*

| TIME | ・・・ | 8:25 | 8:26 | 8:27 | ・・・ | 9:22 | 9:23 | ・・・ |
|---|---|---|---|---|---|---|---|---|
| LATITUDE | | +35. 25. 33. 135 | +35. 25. 44. 456 | +35. 25. 45. 222 | | +35. 35. 10. 123 | +35. 35. 22. 234 | |
| LONGITUDE | | +139. 40. 20. 234 | +139. 40. 50. 123 | +139. 40. 55. 111 | | +139. 45. 10. 567 | +139. 45. 15. 432 | |
| Seg | | — | 1 | 1 | | 6 | — | |

*FIG. 19*

| ON-BOARD UNIT ID | TIME 1 | Seg | TIME 2 | Seg | TIME 3 | Seg | TIME 4 | Seg | TIME 5 | Seg | ・・・ |
|---|---|---|---|---|---|---|---|---|---|---|---|
| 12340001 | 8:26 | 1 | 8:34 | 2 | 8:46 | 4 | 9:06 | 6 | 9:23 | — | |
| 12340008 | 8:32 | 5 | 8:51 | 4 | 9:08 | 3 | 9:22 | — | — | — | |
| ・<br>・<br>・ | | | | | | | | | | | |

TRAFFIC INFORMATION PROCESSING SYSTEM, SERVER DEVICE, TRAFFIC INFORMATION PROCESSING METHOD, AND PROGRAM

RELATED APPLICATIONS

The present application is a National Phase of International Application Number PCT/JP2013/081382, filed Nov. 21, 2013, which claims priority to Japanese Application Number 2012-256519, filed Nov. 22, 2012.

TECHNICAL FIELD

The present invention relates to, for example, a traffic information processing system, a server device, a traffic information processing method, and a program, in which traffic information is collected and processed.

Priority is claimed on Japanese Patent Application No. 2012-256519, filed Nov. 22, 2012, the content of which is incorporated herein by reference.

BACKGROUND ART

Recently, a system has been in widespread use in which a vehicle is equipped with a detecting device that detects various kinds of information in order to detect the congestion state of a road by collecting traffic information, and the information is then fed back to a GPS navigation device of a vehicle. For example, Patent Literature 1 discloses a technique of dividing a map in a mesh form, detecting whether a vehicle has entered or left a region of each mesh through an on-board unit, transmitting the detected information to a center server device, and analyzing the degree of congestion based on the number of vehicles located in a mesh.

CITATION LIST

Patent Literature

[Patent Literature 1]

Japanese Unexamined Patent Application, First Publication No. 2011-070574

SUMMARY OF INVENTION

Technical Problem

However, in the technique disclosed in Patent Literature 1, since only the number of vehicles equipped with the on-board unit is detected, it is difficult to detect an accurate number of vehicles in a certain zone. Thus, since the number of vehicles not equipped with the on-board unit is not considered in the degree of congestion based on only the number of vehicles equipped with the on-board unit, it is unlikely to indicate an accurate degree of congestion.

An object of the present invention is to provide a traffic information processing system, a server device, a traffic information processing method, and a program, which are capable of obtaining a relatively accurate number of vehicles in which vehicles not equipped with an on-board unit are considered in addition to vehicles equipped with the on-board unit.

Solution to Problem (1) According to a first aspect of the present invention, a traffic information processing system includes an on-board unit configured to be installed in a vehicle, an on-board unit-equipped vehicle number-detecting unit configured to detect the number of vehicles equipped with the on-board unit entering a sample area, which is a part of a plurality of zones divided from a place in which vehicles equipped with the on-board unit and vehicles not equipped with the on-board unit travel, based on information received from the on-board unit, a total vehicle number-detecting unit configured to detect the number of all vehicles entering the sample area, a vehicle ratio operation unit configured to calculate a value related to a ratio which is based on the number of vehicles equipped with the on-board unit detected by the on-board unit-equipped vehicle number-detecting unit and the number of all vehicles detected by the total vehicle number-detecting unit, and a total vehicle number-estimating operation unit configured to calculate a total number of vehicles in the zone based on the number of vehicles equipped with the on-board unit entering the zone and the value related to the ratio calculated by the vehicle ratio operation unit.

According to this configuration, it is possible to detect the number of vehicles equipped with the on-board unit entering the sample area and the number of all vehicles entering the sample area and calculate a ratio of two numerical values, and it is possible to perform an operation of estimating the number of all vehicles that have entered a certain zone from the number of vehicles equipped with the on-board unit that have entered the zone using the ratio.

(2) According to a second aspect of the present invention, in the above-described aspect, the total vehicle number-estimating operation unit calculates the number of vehicles equipped with the on-board unit entering the zone based on information indicating a zone in which the on-board unit is located among the plurality of zones that are sequentially detected based on information indicating a position of the on-board unit.

According to this configuration, it is possible to perform an operation of estimating the sequentially changing number of all vehicles entering each zone from the sequentially changing number of vehicles equipped with the on-board unit entering each zone.

(3) Further, according to a third aspect of the present invention, in the above-described aspect, the traffic information processing system further includes an information-collecting device that is connected with a camera. The information-collecting device acquires an image obtained by photographing the vehicle entering the sample area by the camera, and the total vehicle number-detecting unit analyzes the acquired image photographed by the camera, and detects the number of all vehicles entering the sample area.

According to this configuration, it is possible to easily detect the number of vehicles entering the sample area through an image analysis technique.

(4) Further, according to a fourth aspect of the present invention, in the above-described aspect, the information-collecting device includes a wireless communication antenna, the on-board unit receives a radio signal transmitted from the wireless communication antenna, and responds, and the on-board unit-equipped vehicle number-detecting unit counts the number of on-board units that have responded, and calculates the number of vehicles equipped with the on-board unit entering the sample area.

According to this configuration, by transmitting the radio signal to the limited region such as the sample area serving as a part of the zone, it is possible to easily count the number of vehicles equipped with the on-board unit entering the sample area.

(5) Further, according to a fifth aspect of the present invention, in the above-described aspect, the zone is a segment which is a divided area of a road, and a predetermined segment among a plurality of segments is a sample area which is a part of the zone, and the on-board unit-equipped vehicle number-detecting unit calculates the number of vehicles, which is equipped with the on-board unit entering the segment serving as the sample area among the vehicles which is equipped with the on-board unit and the vehicles which is not equipped with the on-board unit that travel in a place divided into a plurality of segments, based on information indicating a segment in which the on-board unit is located among the plurality of segments that are sequentially detected based on the information indicating the position of the on-board unit.

According to this configuration, it is possible to estimate the number of vehicles for each road on which vehicles travel and for each segment.

(6) Further, according to a sixth aspect of the present invention, in the above-described aspect, there are a plurality of sample areas, the on-board unit-equipped vehicle number-detecting unit detects the number of vehicles equipped with the on-board unit entering the sample area in a unit of sample areas, the total vehicle number-detecting unit detects the number of all vehicles entering the sample area in a unit of sample areas, and the vehicle ratio operation unit calculates the value related to the ratio which is based on the number of vehicles equipped with the on-board unit in the sample areas detected by the on-board unit-equipped vehicle number-detecting unit and the number of all vehicles in the sample area detected by the total vehicle number-detecting unit.

According to this configuration, when there is a variation in the presence rate of the vehicles equipped with the on-board unit depending on a region, by setting a plurality of sample areas, it is possible to calculate the ratio based on the value obtained from each sample area and suppress a reduction in the accuracy of the ratio value caused by the variation.

(7) Further, according to a seventh aspect of the present invention, in the above-described aspect, a value indicating a weighting on the number of vehicles present is allocated to the plurality of sample areas in advance, and the vehicle ratio operation unit calculates the value related to the ratio which is based on the number of vehicles equipped with the on-board unit in the sample area detected by the on-board unit-equipped vehicle number-detecting unit, the number of all vehicles in the sample area detected by the total vehicle number-detecting unit, and the value indicating the weighting of each sample area.

According to this configuration, when there is a variation in the presence rate of the vehicles equipped with the on-board unit depending on a region, by setting a plurality of sample areas and allocating a weight corresponding to the presence rate of the vehicles equipped with the on-board unit in each sample area, it is possible to suppress a reduction in the accuracy of the ratio value caused by the variation.

(8) Further, according to an eighth aspect of the present invention, a server device includes an on-board unit-equipped vehicle number-detecting unit configured to detect the number of vehicles equipped with an on-board unit entering a sample area, which is a part of a plurality of zones divided from a place in which vehicles equipped with the on-board unit and vehicles not equipped with the on-board unit travel, based on information received from the on-board unit, a total vehicle number-detecting unit configured to detect a number of all vehicles entering the sample area, a vehicle ratio operation unit configured to calculate a value related to a ratio which is based on the number of vehicles equipped with the on-board unit detected by the on-board unit-equipped vehicle number-detecting unit and the number of all vehicles detected by the total vehicle number-detecting unit, and a total vehicle number-estimating operation unit configured to calculate a total number of vehicles of the zone based on the number of vehicles equipped with the on-board unit entering the zone and the value related to the ratio calculated by the vehicle ratio operation unit.

(9) Further, according to a ninth aspect of the present invention, a traffic information-processing method includes detecting, by an on-board unit-equipped vehicle number-detecting unit, the number of vehicles equipped with an on-board unit entering a sample area, which is a part of a plurality of zones divided from a place in which vehicles equipped with the on-board unit and vehicles not equipped with the on-board unit travel, based on information received from the on-board unit, detecting, by a total vehicle number-detecting unit, the number of all vehicles entering the sample area, calculating, by a vehicle ratio operation unit, a value related to a ratio which is based on the number of vehicles equipped with the on-board unit detected by the on-board unit-equipped vehicle number-detecting unit and the number of all vehicles detected by the total vehicle number-detecting unit, and calculating, by a total vehicle number-estimating operation unit, a total number of vehicles in the zone based on the number of vehicles equipped with the on-board unit entering the zone and the value related to the ratio calculated by the vehicle ratio operation unit.

(10) Further, according to a tenth aspect of the present invention, a program causes a computer to function as an on-board unit-equipped vehicle number-detecting unit configured to detect the number of vehicles equipped with an on-board unit entering a sample area, which is a part of a plurality of zones divided from a place in which vehicles equipped with the on-board unit and vehicles not equipped with the on-board unit travel, based on information received from the on-board unit, a total vehicle number-detecting unit configured to detect the number of all vehicles entering the sample area, a vehicle ratio operation unit configured to calculate a value related to a ratio which is based on the number of vehicles equipped with the on-board unit detected by the on-board unit-equipped vehicle number-detecting unit and the number of all vehicles detected by the total vehicle number-detecting unit, and a total vehicle number-estimating operation unit configured to calculate a total number of vehicles in the zone based on the number of vehicles equipped with the on-board unit entering the zone and the value related to the ratio calculated by the vehicle ratio operation unit.

Advantageous Effects of Invention

According to the traffic information processing system, the server device, the traffic information processing method, and the program, it is possible to obtain a relatively accurate number of vehicles present in a certain zone in which a number of vehicles not equipped with the on-board unit is considered in addition to a number of vehicles equipped with the on-board unit.

BRIEF DESCRIPTION OF DRAWINGS

FIG. 16 is a diagram illustrating a table stored in a storage unit of an on-board unit according to the second embodiment.

FIG. 19 is a diagram illustrating a segment table of a center server device according to the second embodiment.

DESCRIPTION OF EMBODIMENTS (First Embodiment)

Hereinafter, embodiments of the present invention will be described with reference to the appended drawings.

Figure 1:
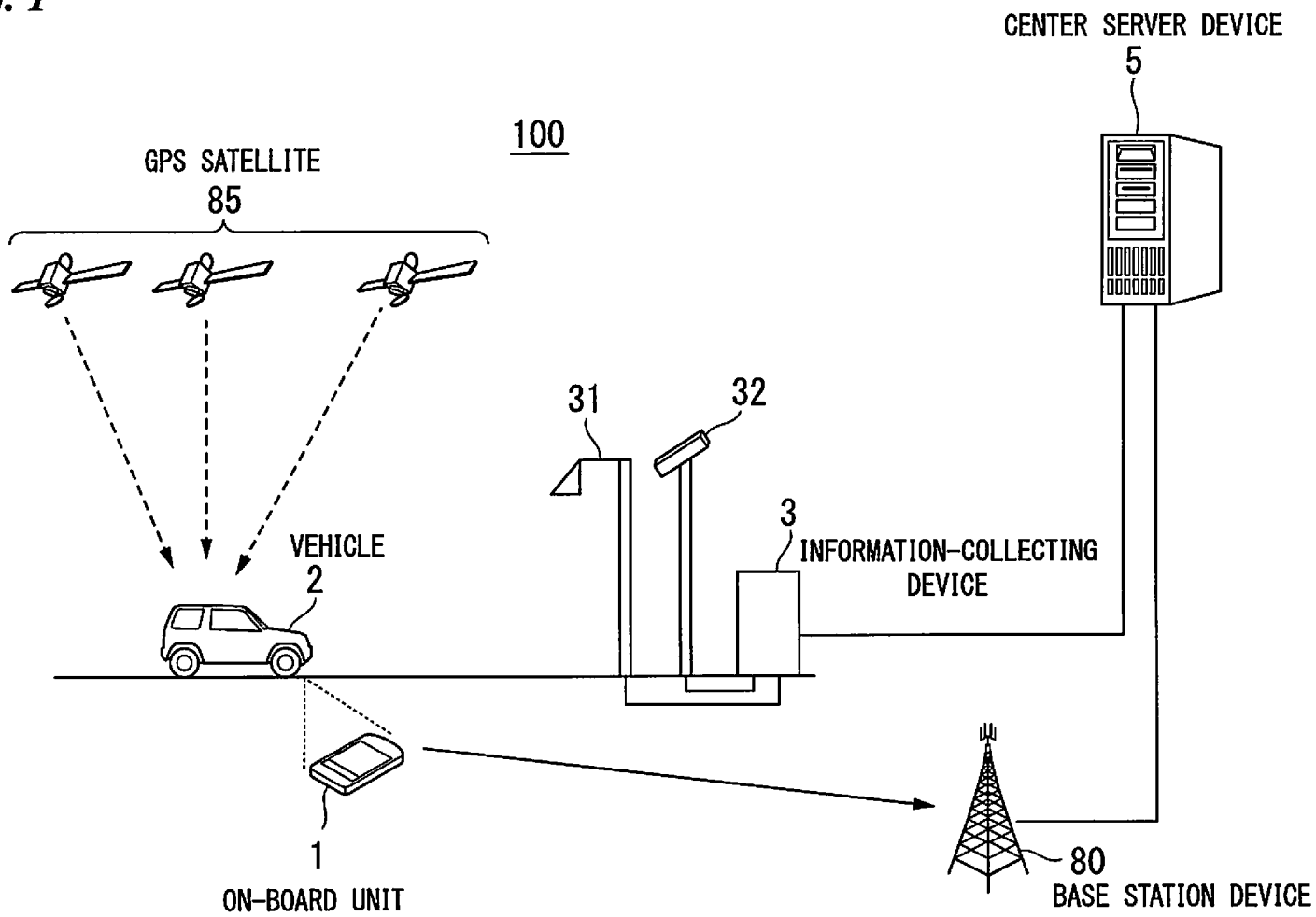
FIG. 1 is a schematic diagram illustrating a traffic information processing system according to a first embodiment of the present invention.

FIG. 1 is a schematic diagram illustrating a traffic information processing system 100 according to a first embodiment of the present invention.

The traffic information processing system 100 includes an on-board unit 1 with which a vehicle 2 traveling on a road is equipped and that is assigned a uniquely identifiable ID (identifier), an information-collecting device 3 connected with a wireless communication antenna 31 and a vehicle-detecting camera 32, a center server device 5, a Global Positioning System (GPS) satellite 85, and a base station device 80 of a mobile phone.

Figure 2:
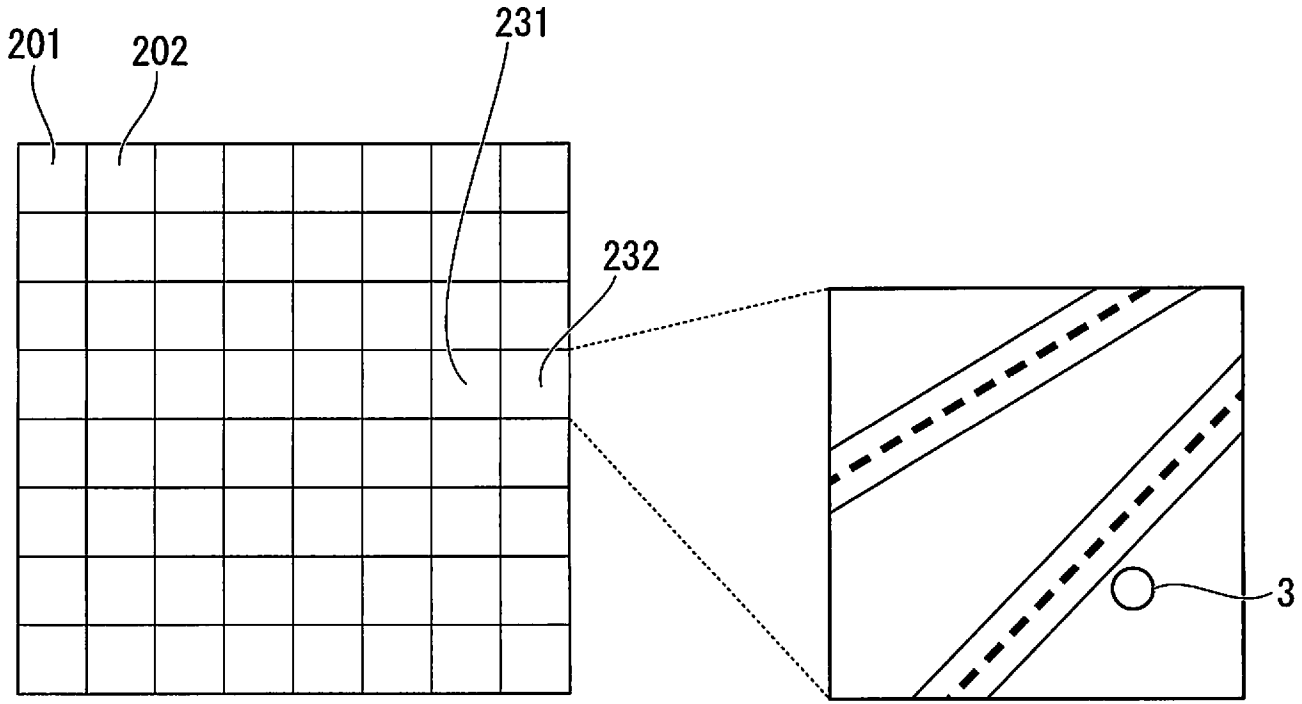
FIG. 2 is a diagram illustrating a configuration of a mesh according to the first embodiment.

FIG. 2 is a diagram for describing a schematic diagram in which a road on which the vehicle 2 travels is segmented in a mesh form. In the traffic information processing system 100, a place in which a road on which the vehicle 2 travels is located is divided into a plurality of meshes 201, 202, . . . , 232, . . . as illustrated in FIG. 2. The meshes are square compartments obtained by dividing land vertically and horizontally at equal intervals, and a plurality of roads may be included in one mesh. For example, two roads extending from the upper right to the lower left are included in the mesh 232. The shape of the mesh is not limited to a square, and may be a rectangle.

The traffic information processing system 100 according to the present embodiment calculates the number of vehicles traveling in a place divided into a plurality of zones in a unit of meshes. The traffic information processing system 100 calculates vehicles in a mesh based on a ratio of the number of vehicles equipped with the on-board unit among the number of vehicles having entered a sample area serving as a part of a mesh. In other words, the vehicles equipped with the on-board unit are regarded to be mixed with the vehicles not equipped with the on-board unit in an entire mesh including the sample area at a ratio of the number of vehicles equipped with the on-board unit to a total number of vehicles having entered the sample area, and a total number of vehicles is calculated in a unit of meshes. That is, in a concept according to the present embodiment, a zone indicates a mesh, and a sample area indicates a checkpoint at which the information-collecting device 3 is installed.

Figure 3:
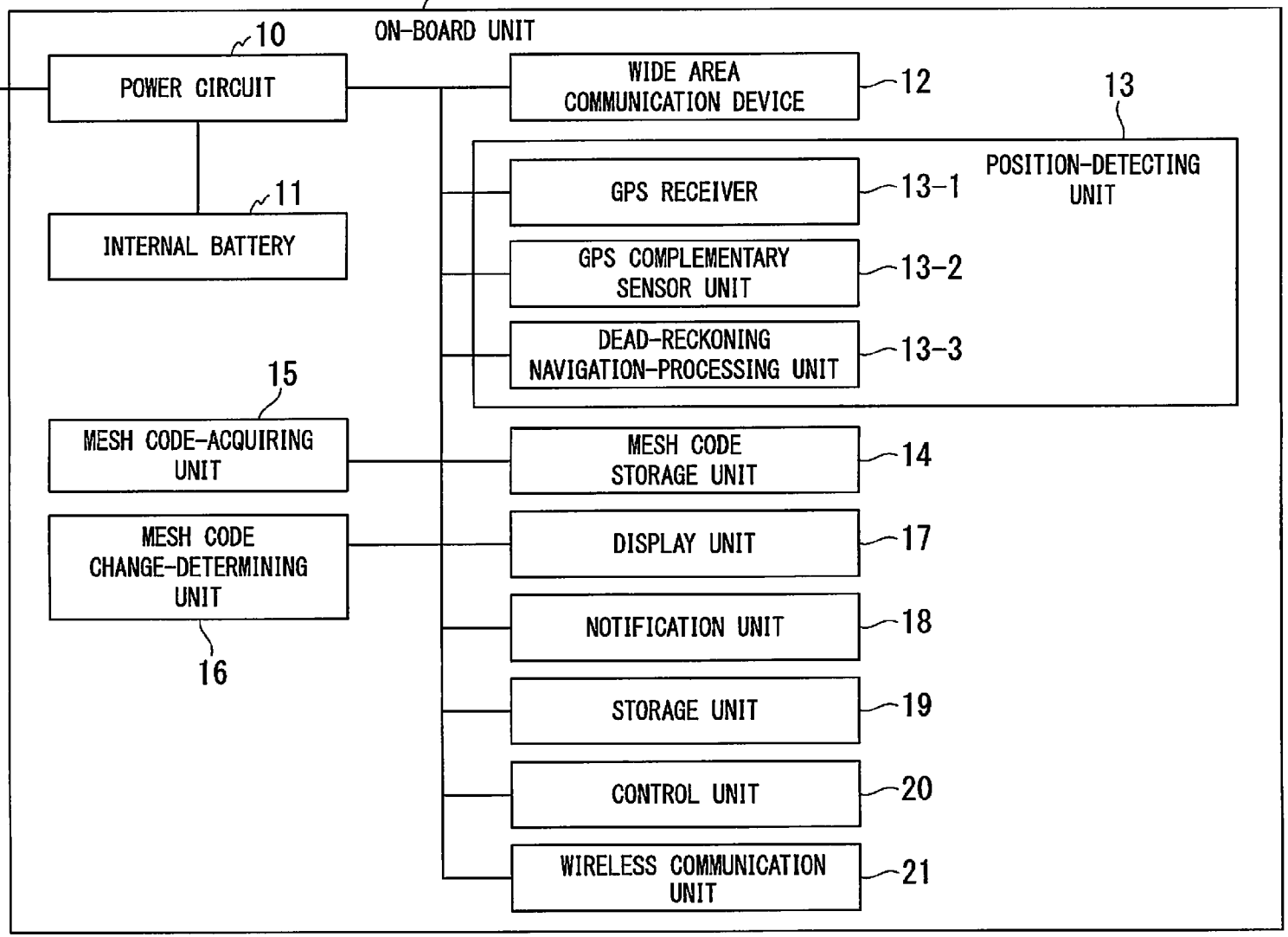
FIG. 3 is a block diagram illustrating an internal configuration of an on-board unit according to the first embodiment.

FIG. 3 is a block diagram illustrating an internal configuration of the on-board unit 1. The on-board unit 1 is a detecting device with which the vehicle 2 is equipped and detects various information. The on-board unit 1 includes a power circuit 10, an internal battery 11, a wide area communication device 12, a position-detecting unit 13, a mesh code storage unit 14, a mesh code-acquiring unit 15, a mesh code change-determining unit 16, a display unit 17, an alarm unit 18, a storage unit 19, a control unit 20, and a wireless communication unit 21. The position-detecting unit 13 includes a GPS receiver 13-1, a GPS complementary sensor unit 13-2, and a dead-reckoning navigation-processing unit 13-3.

In the on-board unit 1, the power circuit 10 includes a regulator that stabilizes a power source and a noise protector, and is supplied with electric power of 12 V or 24 V from the vehicle 2 and supplies the received power to the respective units of the on-board unit 1.

The internal battery 11 is a backup battery, and supplies electric power to each unit to protect data stored in the on-board unit 1 when power supply of the vehicle 2 fails or is interrupted instantaneously.

The wide area communication device 12 is, for example, a mobile phone terminal, and performs communication with the base station device 80 via a communication network of mobile telephone communication and transmits or receives data to or from the center server device 5.

The position-detecting unit 13 detects the position of the on-board unit 1 using the GPS receiver 13-1, the GPS complementary sensor unit 13-2, and the dead-reckoning navigation-processing unit 13-3.

The GPS receiver 13-1 receives radio waves from the GPS satellite 85, reads time information, and measures information of a latitude and a longitude from the received data.

The GPS complementary sensor unit 13-2 includes a gyro sensor and an acceleration sensor, and performs an operation of estimating the position of the on-board unit 1 from information of the gyro sensor and the acceleration sensor. The GPS complementary sensor unit 13-2 may be a configuration unit used, for example, when reception sensitivity of the radio waves received from the GPS satellite 85 is insufficient.

The dead-reckoning navigation-processing unit 13-3 performs an operation of compensating the position of the on-board unit 1 based on the information of the latitude and the longitude measured by the GPS receiver 13-1 and the information of the position of the on-board unit 1 estimated by the GPS complementary sensor unit 13-2 according to the accuracy of the information included in the radio waves received by the GPS receiver 13-1.

The mesh code storage unit 14 stores a uniquely identifiable mesh code previously allocated to each mesh illustrated in FIG. 2 and information indicating a position of each mesh on a map in association with each other. For example, a position of each mesh on a map is indicated by latitudes and longitudes of two points on a diagonal line of each mesh.

Further, data stored in the mesh code storage unit 14 is updated such that the control unit 20 downloads latest data from the center server device 5 through the wide area communication device 12.

The mesh code-acquiring unit 15 detects a mesh including a position indicated by the latitude and the longitude detected by the position-detecting unit 13 from the mesh code storage unit 14, and acquires a mesh code corresponding to the detected mesh.

The mesh code-acquiring unit 15 associates the acquired mesh code with information indicating a time at which the radio waves received by the GPS receiver 13-1 are read, and outputs the associated information.

The mesh code change-determining unit 16 determines whether or not the mesh code stored in the storage unit 19 is identical to the mesh code output from the mesh code-acquiring unit 15. When the two mesh codes are determined not to be identical to each other, the mesh code change-determining unit 16 associates an ID allocated to the on-board unit 1, the two mesh codes used for the determination, and the information indicating the time output from the mesh code-acquiring unit 15 with one another, and transmits the associated information to the center server device 5 through the wide area communication device 12. Further, when the determination ends, the mesh code change-determining unit 16 writes the mesh code output from the mesh code-acquiring unit 15 to be stored in the storage unit 19 as a latest mesh code.

The display unit 17 displays, for example, the information indicating the state of the on-board unit 1 or the position on the map.

The alarm unit 18 includes a speaker therein, and notifies a driver of the vehicle 2 of the information through a buzzer sound or a melodic sound.

The storage unit 19 stores a program or data used in the on-board unit 1, and stores the latest mesh code as described above.

The control unit 20 performs comprehensive management of, for example, transmission and reception of data of the respective units of the on-board unit 1. For example, when the on-board unit 1 also functions as the GPS navigation system, the control unit 20 also performs a path guidance process to a destination included in the GPS navigation system.

When the vehicle enters an on-board unit mounting checkpoint at which the information-collecting device 3 is installed, the wireless communication unit 21 receives radio waves transmitted by the wireless communication antenna 31, and transmits a signal including an ID allocated to the on-board unit 1 as a response.

Figure 4:
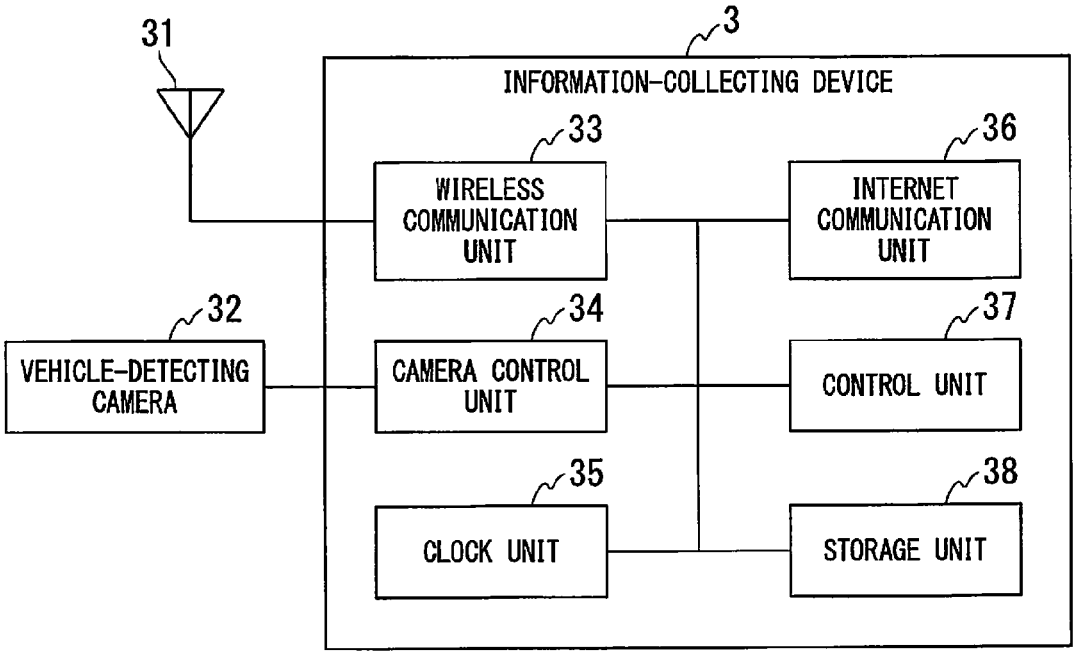
FIG. 4 is a block diagram illustrating an internal configuration of an information-collecting device according to the first embodiment.

FIG. 4 is a block diagram illustrating an internal configuration of the information-collecting device 3. The information-collecting device 3 includes a wireless communication unit 33, a camera control unit 34, a clock unit 35, an Internet communication unit 36, a control unit 37, and a storage unit 38. The wireless communication antenna 31 and the vehicle-detecting camera 32 are separate devices from the information-collecting device 3 and are connected to the information-collecting device 3.

The information-collecting device 3 is installed in a place predetermined as the on-board unit mounting checkpoint, for example, on a road shoulder of one road included in a mesh as illustrated in FIG. 2. Preferably, one or more information-collecting devices 3 are installed in each mesh.

The wireless communication antenna 31 and the vehicle-detecting camera 32 are installed, for example, on a road shoulder of either of an inbound lane and an outbound lane or an iron pole installed above a road around the information-collecting device 3.

In the present embodiment, a direction in which the wireless communication unit 33 transmits the radio signal through the wireless communication antenna 31 is identical to a direction in which the vehicle-detecting camera 32 performs photography.

The wireless communication unit 33 transmits the radio signal through the wireless communication antenna 31, and receives a signal transmitted by the on-board unit 1. The radio signal transmitted through the wireless communication antenna 31 by the wireless communication unit 33 undergoes directivity control, and is transmitted toward an area of one of the inbound and outbound lanes serving as a photography target of the vehicle-detecting camera 32 so that the on-board unit 1 of the vehicle 2 traveling on the other lane does not erroneously respond.

Upon receiving the signal from the on-board unit 1, the wireless communication unit 33 associates the ID of the on-board unit 1 included in the received signal with the information indicating the time acquired from the clock unit 35 when the signal is received, and transmits the associated information to the center server device 5 through the Internet communication unit 36.

The camera control unit 34 performs control of the direction of the vehicle-detecting camera 32 and control of a photography condition, and repeatedly photographs a moving image of a certain period of time at certain intervals. Further, when a moving image is photographed, the camera control unit 34 acquires a start time and an end time from the clock unit 35, associates a file of the photographed moving image with information indicating a photography period of time, and transmits the associated information to the center server device 5 through the Internet communication unit 36.

The clock unit 35 includes an internal clock, and outputs a current time in response to a request.

The Internet communication unit 36 is connected to the center server device 5 via the Internet, and performs transmission and reception of data with the center server device 5.

The control unit 37 performs comprehensive management of, for example, transmission and reception of data of the respective units of the information-collecting device 3.

The storage unit 38 stores a program or data used in the information-collecting device 3.

Figure 5:
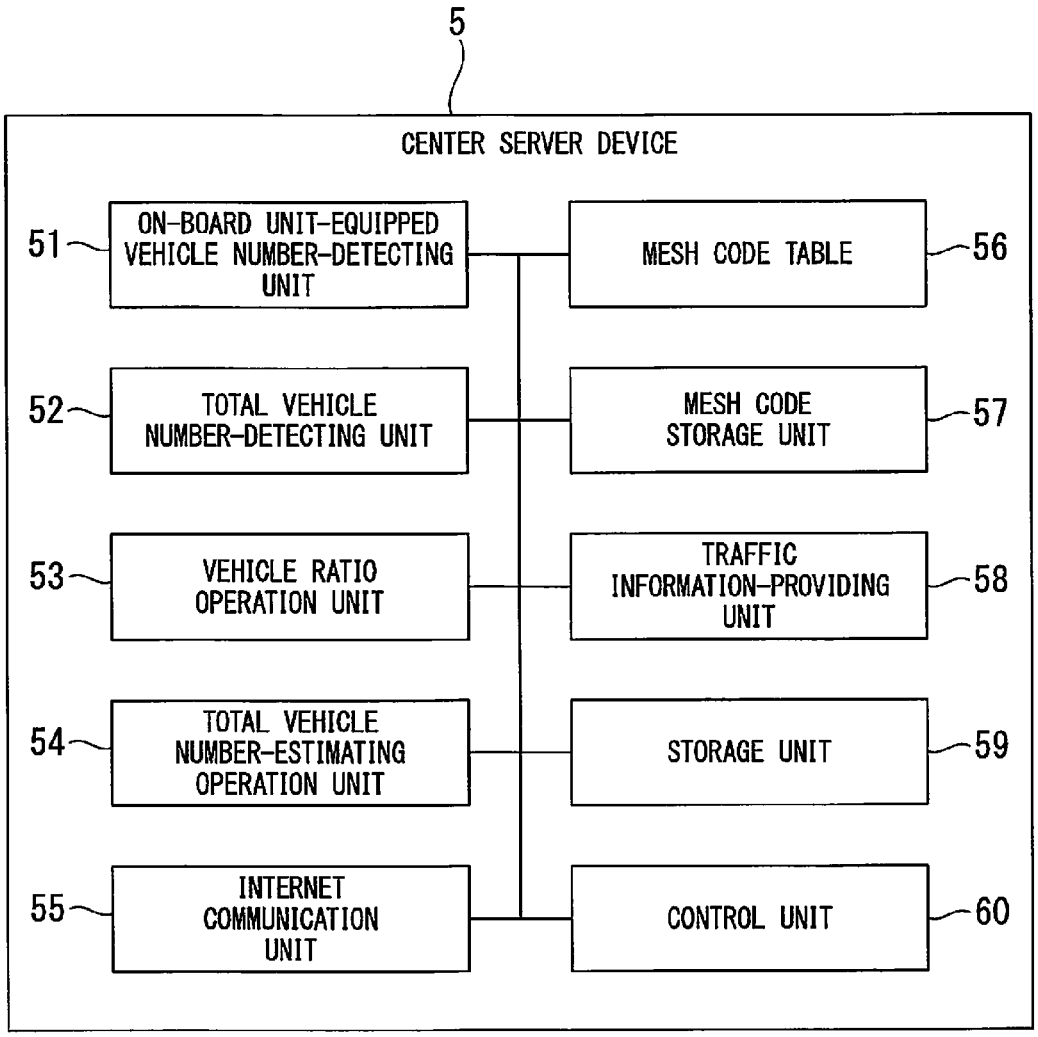
FIG. 5 is a block diagram illustrating an internal configuration of a center server device according to the first embodiment.

FIG. 5 is a block diagram illustrating an internal configuration of the center server device 5. The center server device 5 includes an on-board unit-equipped vehicle number-detecting unit 51, a total vehicle number-detecting unit 52, a vehicle ratio operation unit 53, a total vehicle number-estimating operation unit 54, an Internet communication unit 55, a mesh code table 56, a mesh code storage unit 57, a traffic information-providing unit 58, a storage unit 59, and a control unit 60.

The control unit 60 performs comprehensive management of, for example, transmission and reception of data of the respective units of the center server device 5. The control unit 60 receives information in which the ID of the on-board unit 1 is associated with the information indicating the time, which is transmitted by the information-collecting device 3, through the Internet communication unit 55, and writes the received information to be stored in the storage unit 59.

Further, the control unit 60 receives information in which a moving image file that is photographed by the vehicle-detecting camera 32 is associated with information indicating a photography start time and end time of the moving image, which is transmitted by the information-collecting device 3, and writes the received information to be stored in the storage unit 59. Furthermore, in the present embodiment, the control unit 60 may receive the moving image file periodically transmitted from the vehicle-detecting camera 32 and acquire the photographed image or may transmit a command to request transmission of the moving image file to the vehicle-detecting camera 32 and acquire the photographed image.

In addition, the control unit 60 receives information in which the ID of the on-board unit is associated with a new mesh code and an old mesh code, which is transmitted through the base station device 80 by the on-board unit 1, and writes the received information to be stored in the mesh code table 56.

The storage unit 59 stores a program or data used in the center server device 5. The storage unit 59 includes a table having items such as an ID of an on-board unit and information indicating time as illustrated in FIG. 6A, and stores information in which the ID of the on-board unit 1 and the information indicating the time are associated with each other, which is written by the control unit 60.

Figures 6A, 6B, 7:
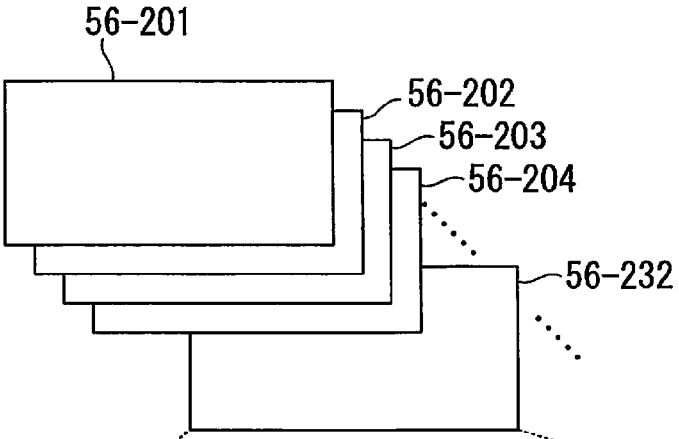
FIG. 6A is a diagram illustrating data stored in a storage unit of a center server device according to the first embodiment.
FIG. 6B is a diagram illustrating data stored in a storage unit of a center server device according to the first embodiment.
FIG. 7 is a diagram illustrating data stored in a mesh code table of a center server device according to the first embodiment.

The storage unit 59 stores moving image files written by the control unit 60, and includes a table that is used to refer to the moving image files, and has items such as a photography start time and end time of the moving image and a moving image file name as illustrated in FIG. 6B. The storage unit 59 stores information indicating a photography start time and end time of a moving image written by the control unit 60 and a corresponding moving image file name through this table.

The mesh code table 56 stores a plurality of tables for each mesh code as illustrated in FIG. 7.

Referring to FIG. 7, a table corresponding to the mesh 201 is a table 56-201, and tables corresponding to the mesh 202 are stored as a table 56-202, sequentially.

Each table includes items "on-board unit ID," "entering time," "leaving time," and "presence detection," and stores information indicating the entering time, the leaving time, and the presence detection for the mesh 232 for each ID of the on-board unit that has entered each mesh, for example, as illustrated in the table 56-232 corresponding to the mesh 232 of FIG. 7.

When a vehicle has already left a corresponding mesh, "-" indicating that an on-board unit having a corresponding ID is not located in the mesh is stored in the "presence detection" item of the table. Further, when the vehicle has entered the mesh but does not leave the mesh, "O" indicating that the on-board unit having the corresponding ID is located in the mesh is stored in the "presence detection" item of the table.

The mesh code storage unit 57 stores the same data as data stored in the mesh code storage unit 14 of the on-board unit 1. The mesh code storage unit 57 stores latest data, and the on-board unit 1 downloads the data stored in the mesh code storage unit 57 and updates the data of the mesh code storage unit 14 as described above.

The on-board unit-equipped vehicle number-detecting unit 51 detects the number of stored IDs of on-board units during an arbitrarily determined period of time from the information of FIG. 6A in which the ID of the on-board unit is associated with the time, which is stored in the storage unit 59, and outputs the detected number as the number of vehicles 2 equipped with the on-board unit.

The total vehicle number-detecting unit 52 reads the moving image file stored in the storage unit 59 with reference to the table illustrated in FIG. 6B, performs image analysis on the read moving image file, and detects the number of vehicles photographed in the moving image.

The vehicle ratio operation unit 53 calculates a ratio of the number of all vehicles to the number of vehicles equipped with the on-board unit 1 based on the number of vehicles 2 equipped with the on-board unit 1 output by the on-board unit-equipped vehicle number-detecting unit 51 and the number of vehicles detected by the total vehicle number-detecting unit 52.

The total vehicle number-estimating operation unit 54 detects the number of vehicles 2 that have entered each mesh at an arbitrarily determined time from the mesh code table 56, and performs an operation of estimating the number of all vehicles located in each mesh at the corresponding time based on the ratio calculated by the vehicle ratio operation unit 53.

The Internet communication unit 55 is connected to the base station device 80 via the Internet network, and performs transmission and reception of data with the on-board unit 1. For example, the traffic information-providing unit 58 transmits information indicating a traffic state calculated by the total vehicle number-estimating operation unit 54 to the on-board unit 1 through the Internet communication unit 55.

[Operation of Information-Collecting Device]

Figure 8:
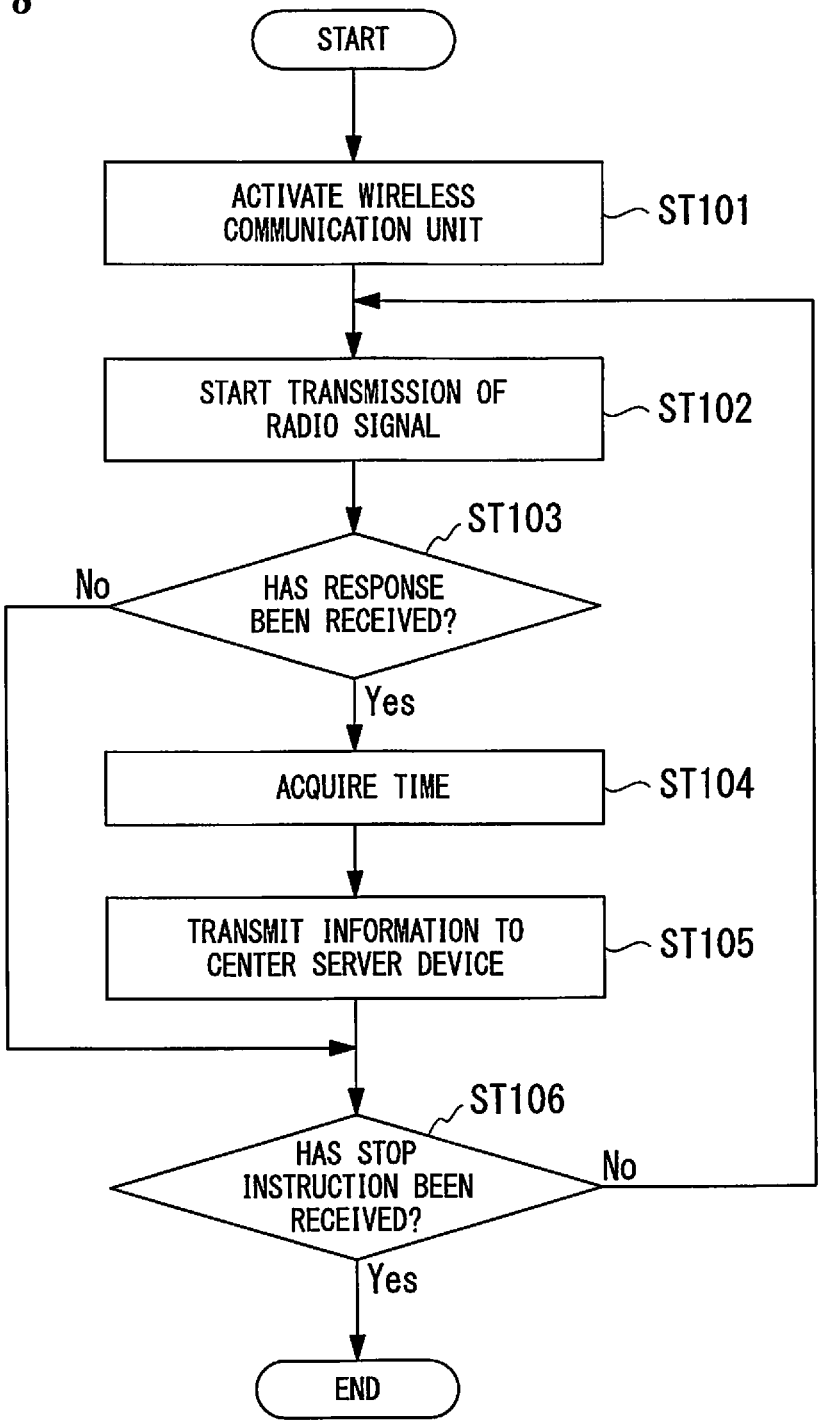
FIG. 8 is a flowchart illustrating an operation of a wireless communication unit of an information-collecting device according to the first embodiment.
Figure 9:
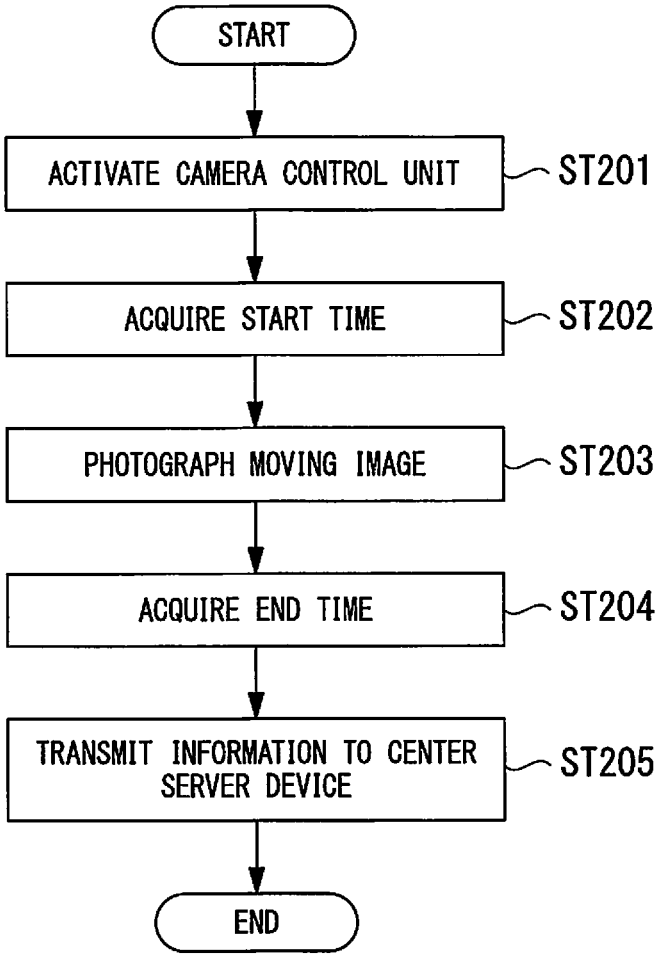
FIG. 9 is a flowchart illustrating an operation of a camera control unit of an information-collecting device according to the first embodiment.

Next, an operation of the information-collecting device 3 will be described with reference to flowcharts of FIGS. 8 and 9.

The information-collecting device 3 performs an operation for a certain period of time at certain intervals. For example, the information-collecting device 3 performs an operation in which activation is performed at 0 minutes and 30 minutes of every hour, and an operation is stopped after the operation is performed for 10 minutes. Control of activation and stop is performed such that the control unit 37 gives an activation instruction and a stop instruction to each functioning unit using time information acquired from the clock unit 35. An operation of the wireless communication unit 33 and an operation of the camera control unit 34 are performed in parallel.

First, an operation of the wireless communication unit 33 illustrated in FIG. 8 will be described.

(Step ST101)

The wireless communication unit 33 is activated by receiving the activation instruction from the control unit 37.

(Step ST102)

Then, the wireless communication unit 33 transmits a radio signal through the wireless communication antenna 31.

(Step ST103)

Then, the wireless communication unit 33 determines whether or not a signal transmitted from the on-board unit 1 as a response to the transmitted radio signal has been received.

(Step ST104)

When the wireless communication unit 33 determines that the signal has been received from the on-board unit 1, the wireless communication unit 33 reads an ID of the on-board unit 1 included in the received signal, and acquires a time from the clock unit 35.

(Step ST105)

Then, the wireless communication unit 33 associates the ID of the on-board unit 1 with the time, and transmits the associated information to the center server device 5 through the Internet communication unit 36. Upon receiving the information in which the ID of the on-board unit 1 is associated with the time from the information-collecting device 3 through the Internet communication unit 55, the control unit 60 of the center server device 5 writes the received information to be stored in the table of the storage unit 59 illustrated in FIG. 6A.

(Step ST106)

On the other hand, when the wireless communication unit 33 determines that the signal has not been received from the on-board unit 1, the wireless communication unit 33 proceeds to a process of step ST106. Then, the wireless communication unit 33 determines whether or not the stop instruction has been received from the control unit 37. The wireless communication unit 33 ends the process when the instruction has been received, and repeats the process of step ST102 when the instruction has not been received.

Next, an operation of the camera control unit 34 illustrated in FIG. 9 will be described.

(Step ST201)

First, the camera control unit 34 is activated by receiving the activation instruction from the control unit 37.

(Step ST202)

Then, the camera control unit 34 acquires a time from the clock unit 35, and temporarily stores the acquired time in the storage unit 38 as the start time.

(Step ST203)

Then, the camera control unit 34 starts to photograph a moving image through the vehicle-detecting camera 32.

(Step ST204)

Thereafter, the camera control unit 34 ends the photography when 10 minutes have elapsed after the photography started, acquires the time from the clock unit 35, and sets the acquired time as the end time.

(Step ST205)

Then, the camera control unit 34 reads the start time from the storage unit 38, associates a moving image file of the photographed moving image, the start time, and the end time with one another, transmits the associated information to the center server device 5 through the Internet communication unit 36, and ends the operation.

Upon receiving the information through the Internet communication unit 55, the control unit 60 of the center server device 5 reads the moving image file from the information, and writes the read moving image file in the storage unit 59. Further, the control unit 60 of the center server device 5 reads the information indicating the start time and the end time from the information received through the Internet communication unit 55, and writes the start time, the end time, and the moving image file name in the table illustrated in FIG. 6B in association with one another.

Through the operation of the information-collecting device 3, it is possible to photograph all vehicles passing through the on-board unit mounting checkpoint through the vehicle-detecting camera 32 and collect information necessary to count the number of vehicles 2 equipped with the on-board unit 1 passing through the on-board unit mounting checkpoint.

[Operation of on-Board Unit]

Figure 10:
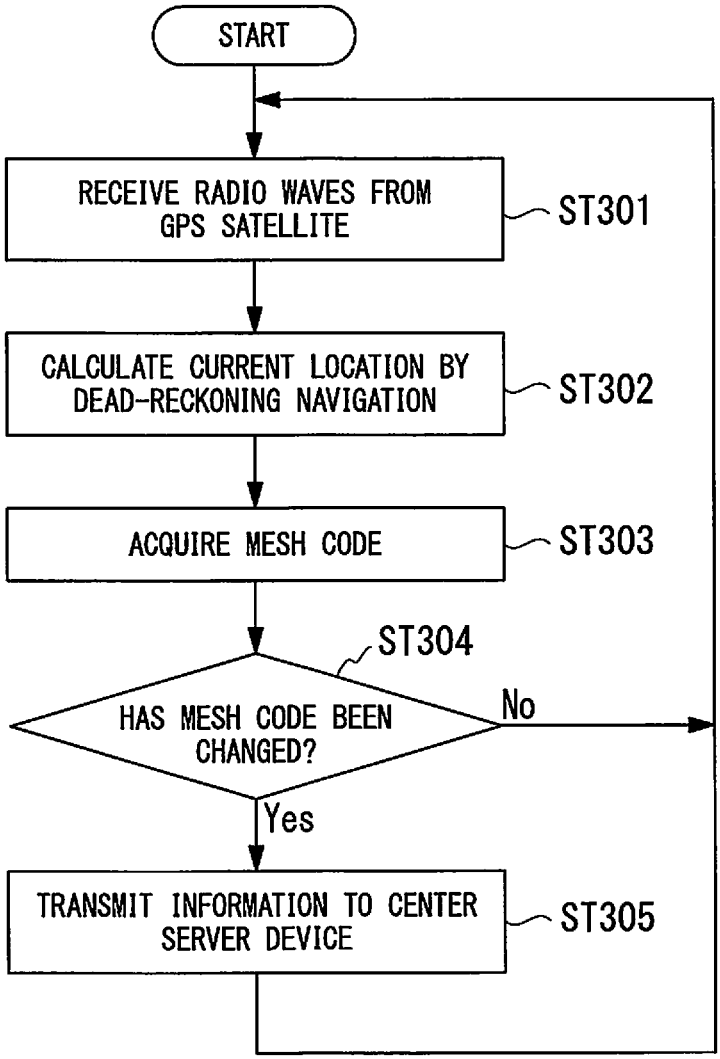
FIG. 10 is a flowchart illustrating an operation of an on-board unit according to the first embodiment.

Next, an operation of the on-board unit 1 will be described with reference to a flowchart of FIG. 10.

(Step ST301)

For example, the vehicle 2 is assumed to have traveled on the road extending from the mesh 231 to the mesh 232 and then entered the mesh 232. The GPS receiver 13-1 of the on-board unit 1 of the vehicle 2 receives the radio waves from the GPS satellite 85 with a certain period. The GPS receiver 13-1 measures a latitude and a longitude from information included in the received radio waves, and outputs the information of the latitude and the longitude, time information included in the received radio waves, and information indicating reliability of the information included in the received radio waves.

In the present embodiment, the GPS receiver 13-1 outputs information in which information indicating that the position of the on-board unit 1-1 is a point P1 (latitude $\psi_1$, longitude $\lambda_1$), information indicating that a time at which the position is detected is "9:01," and information indicating reliability "high" are associated.

(Step ST302)

Then, the GPS complementary sensor unit 13-2 performs an operation of estimating the position at which the on-board unit 1 is located at the time "9:01" output by the GPS receiver 13-1 based on a rotation direction of the vehicle 2 obtained from the gyro sensor and information of a velocity of the vehicle 2 obtained from the acceleration sensor. In the present embodiment, the GPS complementary sensor unit 13-2 is assumed to obtain information indicating a point P2 (latitude $\psi_2$, longitude $\lambda_2$) as the position of the on-board unit 1 based on the operation result.

Figure 11:
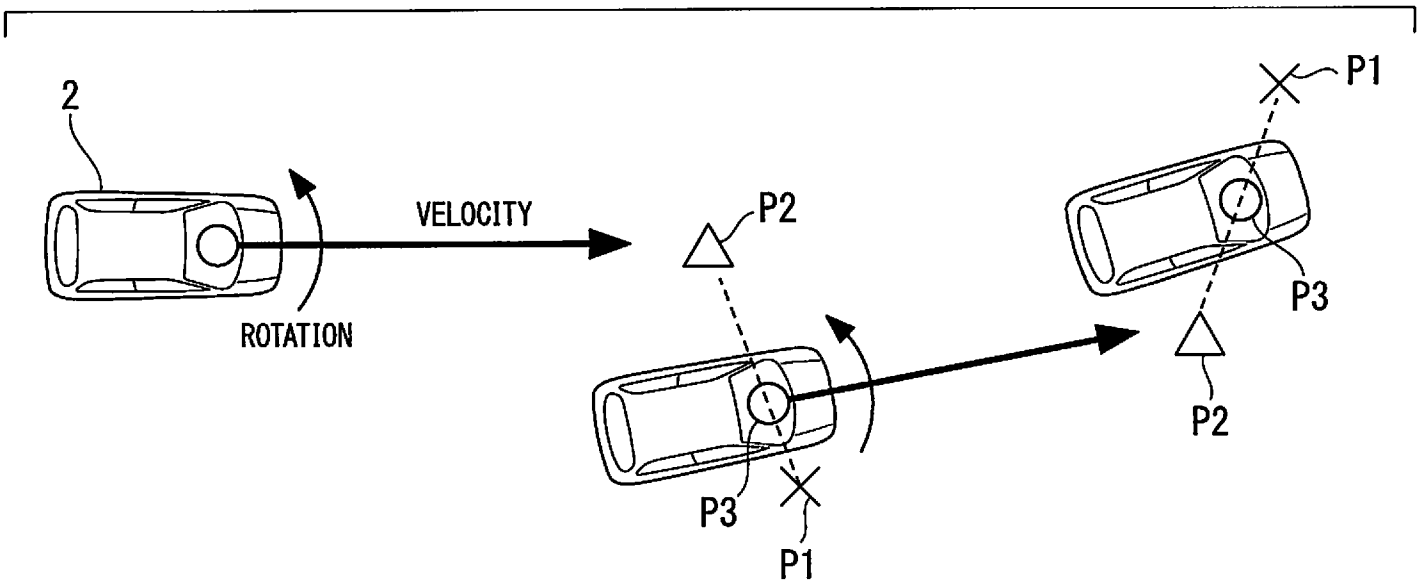
FIG. 11 is a diagram for describing processing of a dead-reckoning navigation-processing unit according to the first embodiment.

Then, the dead-reckoning navigation-processing unit 13-3 calculates the position of the on-board unit 1 through a technique illustrated in FIG. 11 using information of the two positions obtained from the GPS receiver 13-1 and the GPS complementary sensor unit 13-2.

Specifically, the GPS complementary sensor unit 13-2 recognizes the position of the on-board unit 1 measured by the operation as the position indicated by the point P2 (latitude $\psi_2$, longitude $\lambda_2$), and recognizes the position based on the information of the latitude and the longitude output by the GPS receiver 13-1 as the point P1 (latitude $\psi_1$, longitude $\lambda_1$). In this case, the dead-reckoning navigation-processing unit 13-3 weights the reliability of the information output by the GPS receiver 13-1, and calculates the position of the point P3 (latitude $\psi_3$, longitude $\lambda_3$) as the position of the on-board unit 1 through a weight averaging operation. In other words, when the reliability of the information output by the GPS receiver 13-1 is higher, the position of the point P3 (latitude $\psi_3$, longitude $\lambda_3$) is closer to the position of the point P1 (latitude $\psi_1$, longitude $\lambda_1$) output by the GPS receiver 13-1.

The dead-reckoning navigation-processing unit 13-3 associates the information (that is, the information indicating the point P3 (latitude $\psi_3$, longitude $\lambda_3$)) of the calculated position with the time information "9:01" output by the GPS receiver 13-1 and outputs the associated information to the mesh code-acquiring unit 15.

Further, the position serving as a starting point when the GPS complementary sensor unit 13-2 performs an operation of estimating the position is the position indicated by the point P3 (latitude $\psi_3$, longitude $\lambda_3$).

(Step ST303)

Then, the mesh code-acquiring unit 15 receives the point P3 (latitude $\psi_3$, longitude $\lambda_3$) serving as the position information and the time information "9:01" from the dead-reckoning navigation-processing unit 13-3, reads a set of latitude and longitude information indicating the position of each mesh stored in the mesh code storage unit 14, detects a mesh including the position received from the dead-reckoning navigation-processing unit 13-3, and acquires a mesh code corresponding to the detected mesh.

Upon acquiring the mesh code, the mesh code-acquiring unit 15 outputs the acquired mesh code and the information indicating the time to the mesh code change-determining unit 16.

(Step ST304)

Then, the mesh code change-determining unit 16 reads an immediately previously acquired mesh code stored in the storage unit 19, and determines whether or not the read mesh code is identical to the mesh code output by the mesh code-acquiring unit 15.

(Step ST305)

When the mesh codes are determined not to be identical to each other, that is, when the mesh code is determined to have changed, the mesh code change-determining unit 16 associates the ID allocated to the on-board unit 1, the latest mesh code output by the mesh code-acquiring unit 15, the mesh code read from the storage unit 19, and the information indicating the time with one another, and transmits the associated information to the center server device 5 through the wide area communication device 12. Then, the mesh code change-determining unit 16 writes the latest mesh code to be stored in the storage unit 19, and repeats the process from step ST301.

On the other hand, when the mesh codes are determined to be identical to each other, that is, when the mesh code is determined not to have changed, the mesh code change-determining unit 16 writes the latest mesh code output by the mesh code-acquiring unit 15 to be stored in the storage unit 19, and repeats the process from step ST301.

Upon receiving the ID of the on-board unit 1, the old mesh code, the new mesh code, and the information indicating the time from the on-board unit 1 through the Internet communication unit 55, the control unit 60 of the center server device 5 reads the old mesh code, and detects the table corresponding to the old mesh code from the mesh code table 56. Here, since the old mesh code is 231, the table 56-231 is detected, the reception time is written in the column of the leaving time of the on-board unit ID corresponding to the table 56-231, and "-" indicating the state in which the on-board unit 1 has left is recorded in the column of the presence detection.

Next, the control unit 60 reads the new mesh code from the received information, and detects the table corresponding to the read new mesh code from the mesh code table 56.

Here, since the new mesh code is 232, the table 56-232 is detected, a row of a newly received on-board unit ID is added to the table 56-232, the reception time is written in the item of the entering time of the added row, and "O" indicating the state in which the on-board unit 1 is currently present is recorded in the column of the presence detection.

The above process is performed through the on-board units 1 with which a plurality of vehicles 2 are equipped, and each time a plurality of on-board units 1 enter other meshes, the entering time, the leaving time, and the presence detection are updated, and information is accumulated in the corresponding tables of the mesh code table 56 of the center server device 5.

Further, when the mesh code is initially acquired by the mesh code-acquiring unit 15, an immediately previous mesh code is not stored in the storage unit 19. In this case, the mesh code change-determining unit 16 is assumed to determine that the mesh code has changed even when the mesh code is newly acquired from the state in which there is no immediately previous mesh code.

Through the operation of the on-board unit 1, the center server device 5 can collect information related to a mesh that the vehicle 2 equipped with the on-board unit 1 enters or leaves, an entering time, and a leaving time.

[Operation of Center Server Device]

Next, an operation of the center server device 5 will be described with reference to FIG. 12.

(Step ST401)

First, the on-board unit-equipped vehicle number-detecting unit 51 of the center server device 5 selects a target period of time in which an on-board unit mounting rate is calculated. The selection of the period of time may be arbitrarily performed by an operator of the center server device 5, but in this example, since a photography interval of a moving image is 0 minutes and 30 minutes of every hour, and the photography is performed for 10 minutes, any one period of time among these periods of time is selected. Here, 9:00 to 9:10 is assumed to be selected.

(Step ST402)

The on-board unit-equipped vehicle number-detecting unit 51 counts the number of on-board units 1 from which data has been received from 9:00 to 9:10 from the table of the storage unit 59 illustrated in FIG. 6A, and calculates the number of vehicles equipped with the on-board unit.

(Step ST403)

Then, the total vehicle number-detecting unit 52 reads a moving image 1 serving as a moving image file photographed from 9:00 to 9:10 from the storage unit 59 with reference to the table of the storage unit 59 illustrated in FIG. 6B. The total vehicle number-detecting unit 52 performs image analysis on the file of the read moving image 1, and calculates the number of vehicles that have traveled past the on-board unit mounting checkpoint from 9:00 to 9:10.

(Step ST404)

Then, the vehicle ratio operation unit 53 calculates the ratio of the number of all vehicles to the number of vehicles equipped with the on-board unit based on the number of vehicles equipped with the on-board unit calculated by the on-board unit-equipped vehicle number-detecting unit 51 and the number of vehicles calculated by the total vehicle number-detecting unit 52.

(Step ST405)

Then, the total vehicle number-estimating operation unit 54 selects a time at which a total number of vehicles in a mesh is desired to be checked, and detects the number of vehicles 2 that have entered at the selected time from the tables 56-201, 56-202, . . . of the mesh code table 56.

Specifically, the total vehicle number-estimating operation unit 54 performs the detecting of the number of vehicles 2 by counting the number of IDs of the on-board units that have entered a the selected time but have not left with reference to the mesh code table 56.

(Step ST406)

Then, the total vehicle number-estimating operation unit 54 performs an operation of estimating the number of all vehicles serving as a sum of the number of vehicles equipped with the on-board unit and the number of vehicles not equipped with the on-board unit in each mesh using the number of detected vehicles of each mesh and the ratio calculated by the vehicle ratio operation unit 53.

For example, when the operation performed by the vehicle ratio operation unit 53 is an operation of dividing the number of vehicles equipped with the on-board unit by the number of all vehicles, the total vehicle number-estimating operation unit 54 can calculate a value indicating an estimation of the number of all vehicles in each mesh by dividing the number of vehicles of each mesh calculated in step ST405 by the value calculated by the vehicle ratio operation unit 53.

Then, the total vehicle number-estimating operation unit 54 outputs the value indicating the estimated number of all vehicles to the traffic information-providing unit 58. The traffic information-providing unit 58 may provide this value by transmitting this value to the on-board unit 1 without change as information indicating the degree of congestion or may provide image information that is illustrated based on this value so that a congested mesh is easily understood.

Through the configuration of the first embodiment, the accurate number of vehicles can be obtained in view of the number of vehicles not equipped with the on-board unit as well as the vehicles equipped with the on-board unit. Further, an accurate degree of congestion can be obtained based on the obtained number of vehicles in the mesh. The present embodiment has been described in connection with an example in which the degree of congestion is obtained based on the number of all vehicles in the mesh, but the present invention is not limited to this example. For example, it is possible to understand the flow or motions of people by chronologically analyzing a change in the number of all vehicles in the mesh. Information used to understand the flow or activity of people is effective information in marketing strategies and the like.

Further, in the configuration of the first embodiment, information of the number of vehicles equipped with the on-board unit 1 and the number of all vehicles to pass through is collected in a limited range such as the limited on-board unit mounting checkpoint of one mesh through one information-collecting device 3. Then, the center server device 5 uses the information collected by the information-collecting device 3 for the operation of estimating the number of all vehicles in each mesh. Thus, it is unnecessary to install the device that detects the number of vehicles in all meshes, and thus it is possible to reduce a system installation cost.

Figure 13:
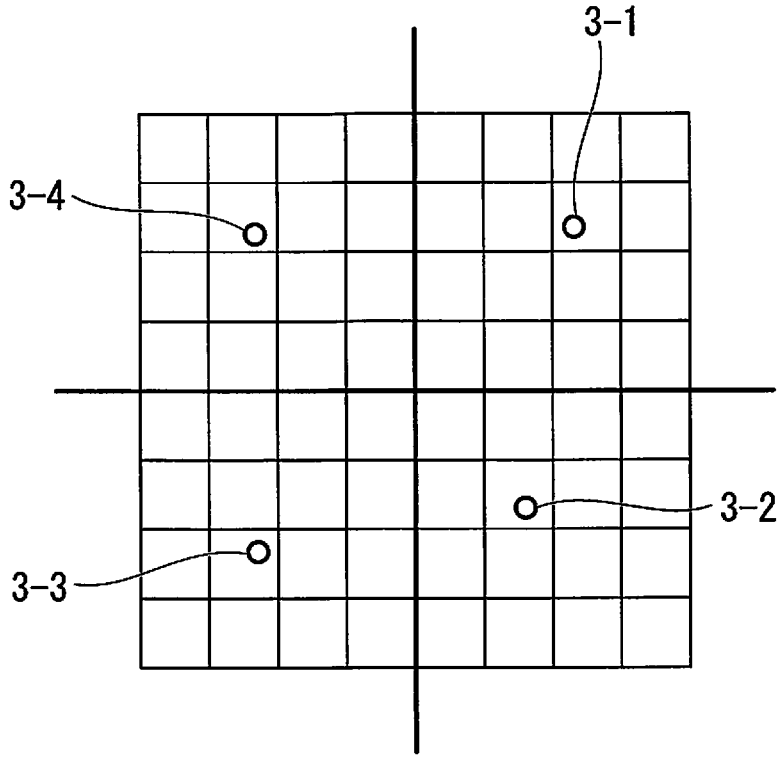
FIG. 13 is a diagram illustrating an example of an arrangement of an on-board unit mounting checkpoints according to the first embodiment.

Further, in the first embodiment, the information-collecting device 3 is installed at one on-board unit mounting checkpoint, but when the ratio of the number of all vehicles to the number of vehicles equipped with the on-board unit differs according to an area, a plurality of points 3-1 to 3-4 may be installed as illustrated in FIG. 13. When a plurality of points are installed as described above, the vehicle ratio operation unit 53 may calculate a sum value of the number of vehicles equipped with the on-board unit of each point calculated by the on-board unit-equipped vehicle number-detecting unit 51 and a sum value of the number of all vehicles of each point calculated by the total vehicle number-detecting unit 52 and calculate the ratio based on the sum values. Further, an average value of the number of vehicles equipped with the on-board unit of each point and an average value of the number of all vehicles of each point may be calculated, and the ratio may be calculated based on the values. Furthermore, when there is a variation in each point, the ratio may be calculated in view of a weighting according to a distribution thereof.

Figure 12:
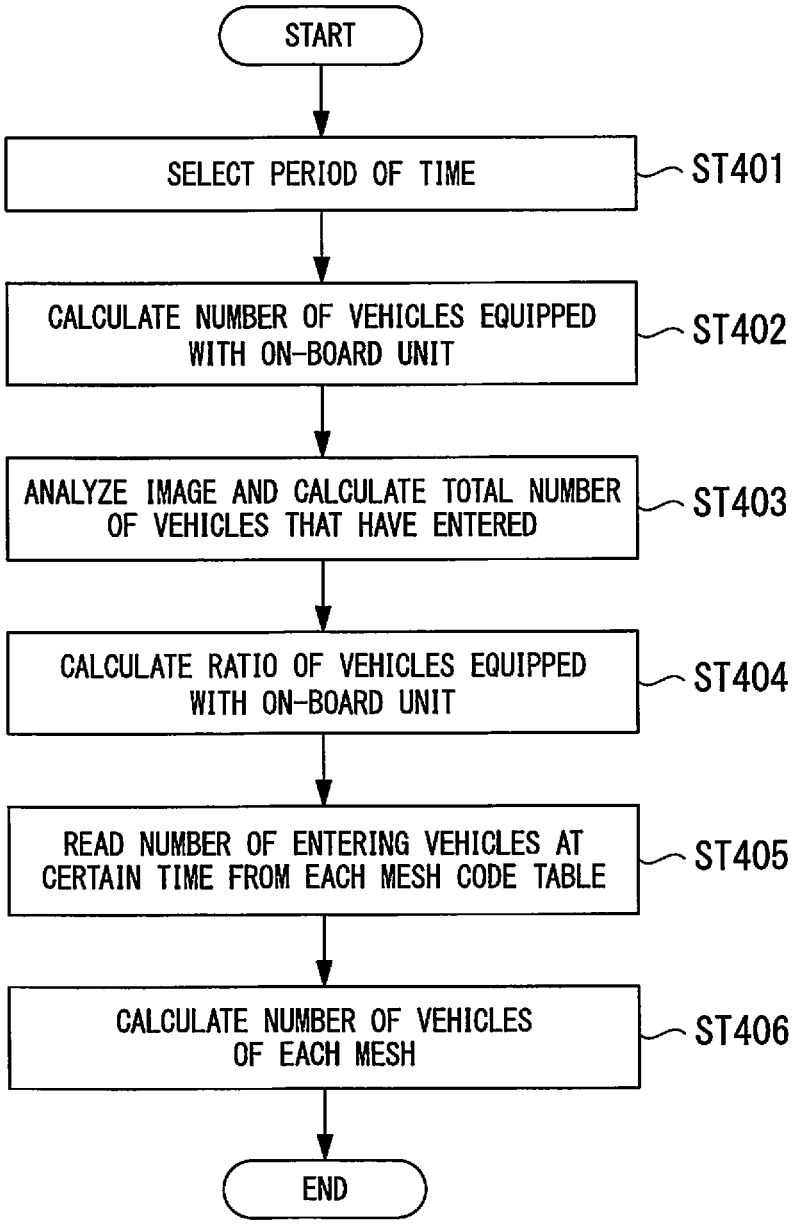
FIG. 12 is a flowchart illustrating an operation of a center server device according to the first embodiment.

Further, in the configuration of the first embodiment, a time is selected in step ST405 of FIG. 12, but the number of all vehicles of each mesh may be estimated at a point in time at which the process of FIG. 12 is performed. When the number of all vehicles of each mesh is estimated at the point in time, the number of on-board unit IDs in which the "presence detection" item of each table of the mesh code table 56 indicated by "O" may be counted Thus, it is possible to calculate the number of vehicles 2 that have entered each mesh at a corresponding point in time.

[Second Embodiment]

Figure 14:
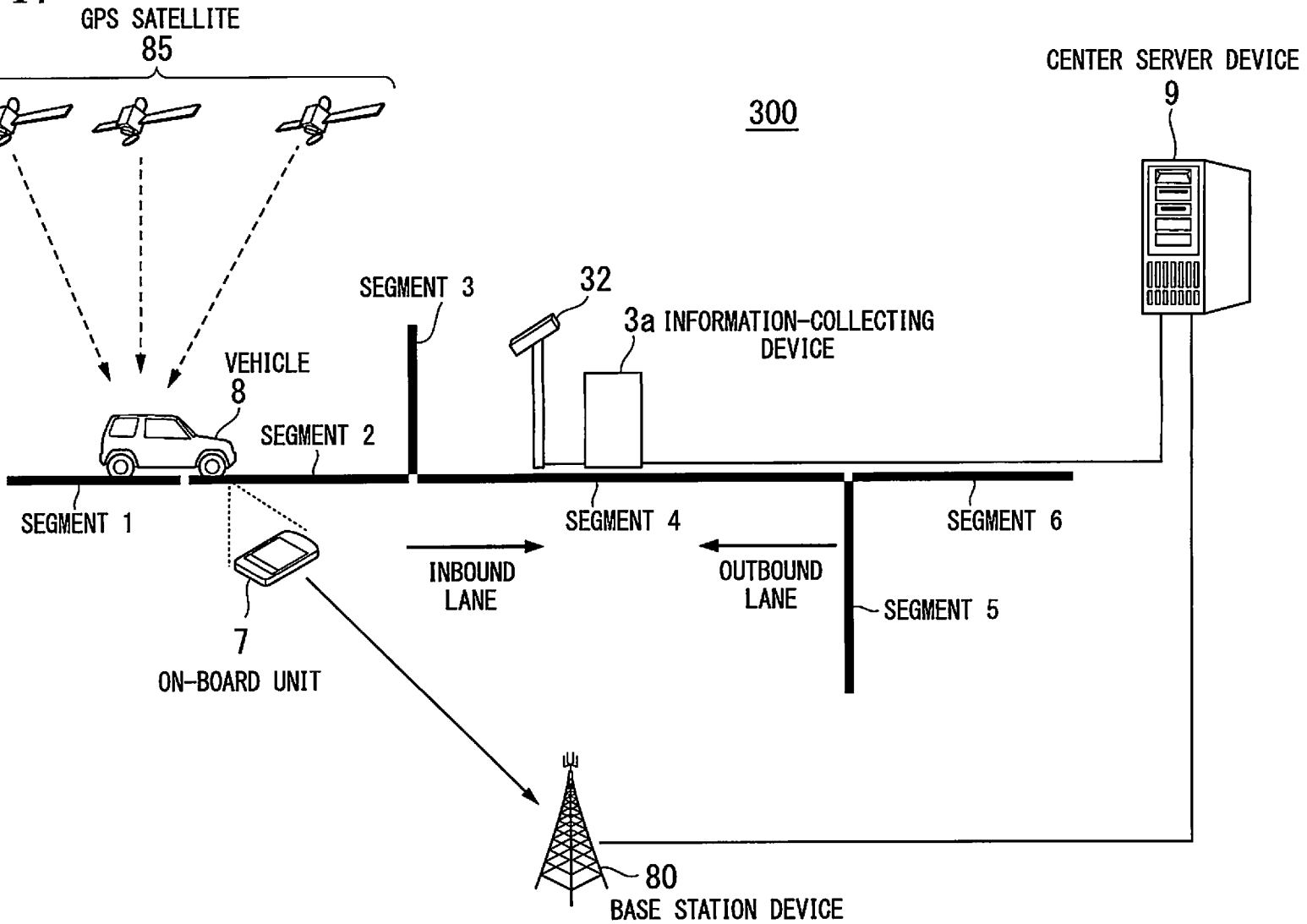
FIG. 14 is a schematic diagram illustrating a traffic information processing system according to a second embodiment of the present invention.

Next, a traffic information processing system 300 according to a second embodiment of the present invention will be described. FIG. 14 is a schematic diagram illustrating the traffic information processing system 300. The traffic information processing system 300 includes an on-board unit 7 with which a vehicle 8 traveling on a road is equipped and has a uniquely identifiable ID, an information-collecting device 3*a* connected with a vehicle-detecting camera 32, a center server device 9, a GPS satellite 85, and a base station device 80 of a mobile phone.

In the traffic information processing system 300, a road on which the vehicle 8 travels is divided into a plurality of areas called segments in advance, and each of the segments is allocated a uniquely identifiable ID such as segment 1, 2, 3 . . .

Further, in the traffic information processing system 300, the on-board unit mounting checkpoint at which the information-collecting device 3*a* is installed is one of an inbound lane and an outbound lane of any one segment, and a direction in which the vehicle-detecting camera 32 performs the photography is one lane serving as a target of a target segment. Here, as an example, an entrance of the inbound lane of the segment 4 is assumed to be set as the on-board unit mounting checkpoint, and the vehicle-detecting camera 32 is assumed to be set to photograph the entrance of the inbound lane of the segment 4.

Further, the traffic information processing system 300 according to the present embodiment calculates the number of vehicles traveling on a road divided into a plurality of zones for each segment. For example, the traffic information processing system 100 calculates the number of vehicles in the mesh based on the ratio of the number of vehicles equipped with the on-board unit to the number of vehicles having entered a sample area serving as a part of a zone including a plurality of segments. In other words, in a concept of the present embodiment, a zone indicates a region including a plurality of segments, and a sample area indicates a segment in which the information-collecting device 3 is installed. The present embodiment will be described in connection with an example in which a sample area is one segment, but the present invention is not limited to this example, and a sample area may be a region configured with a plurality of segments.

Figure 15:
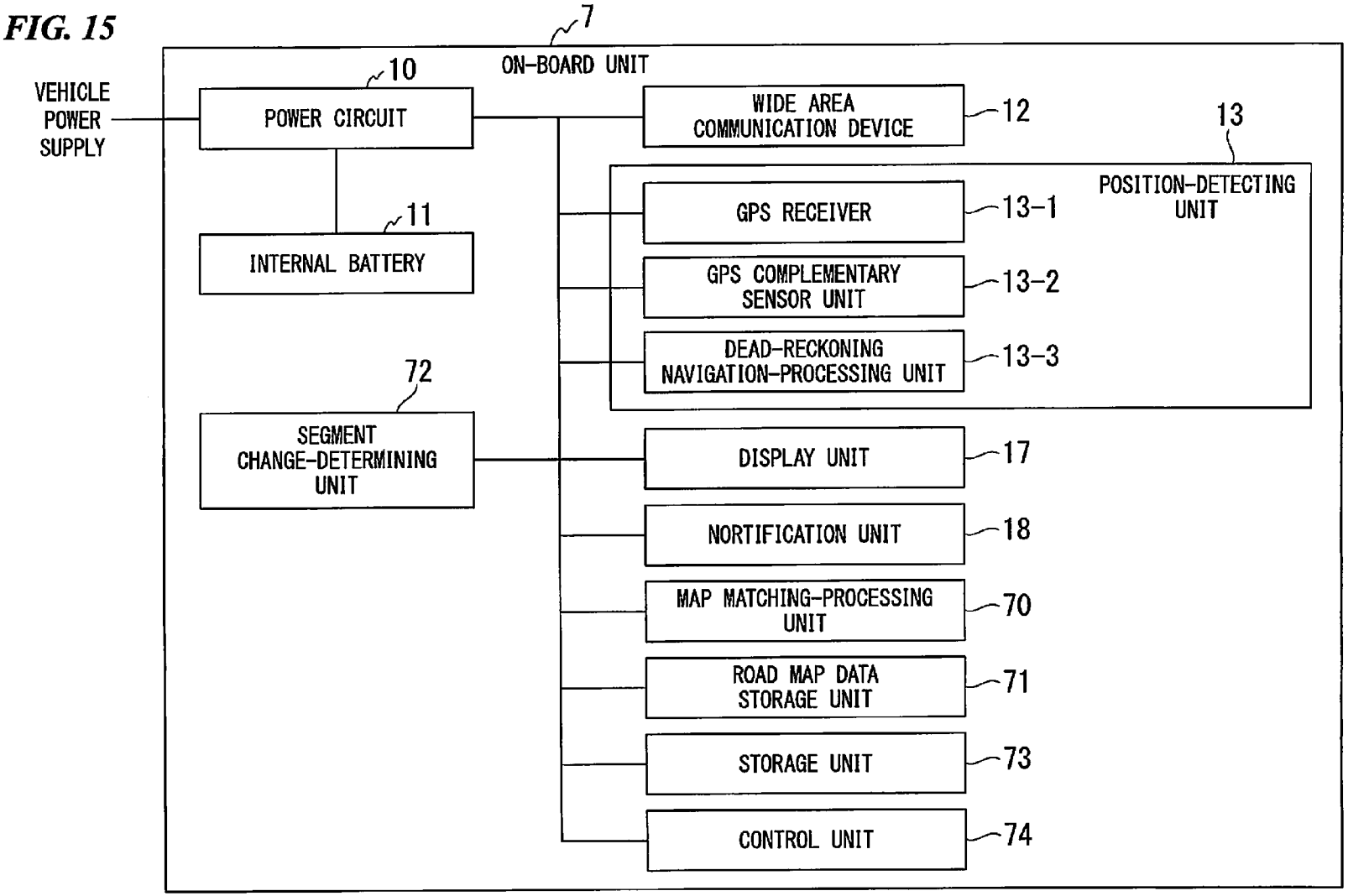
FIG. 15 is a block diagram illustrating an internal constitution of an on-board unit according to the second embodiment.

FIG. 15 is a block diagram illustrating an internal configuration of the on-board unit 7. The same functioning units as in the on-board unit 1 of the first embodiment are denoted by the same reference numerals, and different configurations will be described below.

In the on-board unit 7, a map matching-processing unit 70 performs matching of information of a position of a segment stored in a road map data storage unit 71 and information of the position of the on-board unit 1 detected by the position-detecting unit 13, and detects a segment in which the on-board unit 7 is located. In other words, the map matching-processing unit 70 is an example of a configuration unit functioning as a segment detecting unit that detects a segment corresponding to a position detected by the position-detecting unit 13 from among a plurality of segments serving as areas obtained by dividing a road.

A segment change-determining unit 72 determines, for example, whether or not the on-board unit 7 has entered a new segment based on a result of the detecting process of the map matching-processing unit 70. For example, when the on-board unit 7 is determined to have entered a new segment, the segment change-determining unit 72 transmits information in which an ID of the segment that the on-board unit 7 has newly entered, information related to a time, and an on-board unit ID are associated with one another to the center server device 9 through the wide area communication device 12.

A storage unit 73 stores a program or data used in the on-board unit 7. The storage unit 73 includes a table in which the information of the latitude and the longitude detected by the position-detecting unit 13 and a segment ID obtained as a result of matching performed by the map matching-processing unit 70 are stored in association with the time information included in the radio waves received from the GPS satellite 85, for example, as illustrated in FIG. 16.

In the table, an item (an item indicated by "-") in which there is no record in the segment ID indicates that no segment is detected in the map matching-processing unit 70.

The control unit 74 performs comprehensive management of, for example, transmission and reception of data of the respective units of the on-board unit 7. For example, when the on-board unit 7 also functions as the GPS navigation system, the control unit 74 also performs a path guidance process to a destination included in the GPS navigation system, a process of selecting an optimal path to a destination based on information indicating the degree of congestion received from the center server device 9, and the like.

The road map data storage unit 71 stores road map data in a segment format, and information of a latitude and a longitude of a starting point and an ending point of each segment and information indicating a connection relation of segments are included. All roads are not necessarily divided into segments, and a road in which the degree of congestion is desired to be detected is assumed to be stored in a segment format. Further, data stored in the road map data storage unit 71 is updated such that the control unit 74 downloads latest data from the center server device 9 through the wide area communication device 12.

Figure 17:
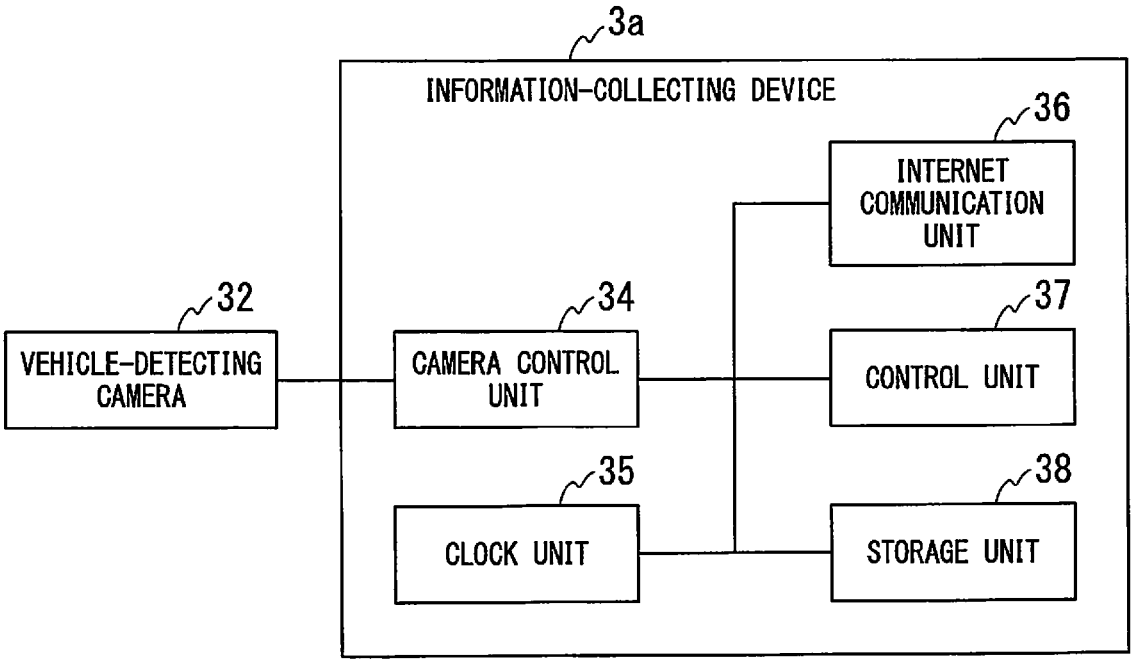
FIG. 17 is a block diagram illustrating an internal configuration of an information-collecting device according to the second embodiment.

FIG. 17 is a block diagram illustrating an internal configuration of the information-collecting device 3*a*. The information-collecting device 3*a* has a similar configuration to the information-collecting device 3 except that the wireless communication antenna 31 and the wireless communication unit 33 are removed from the information-collecting device 3 of the first embodiment, and therefore a detailed description thereof is omitted.

Figure 18:
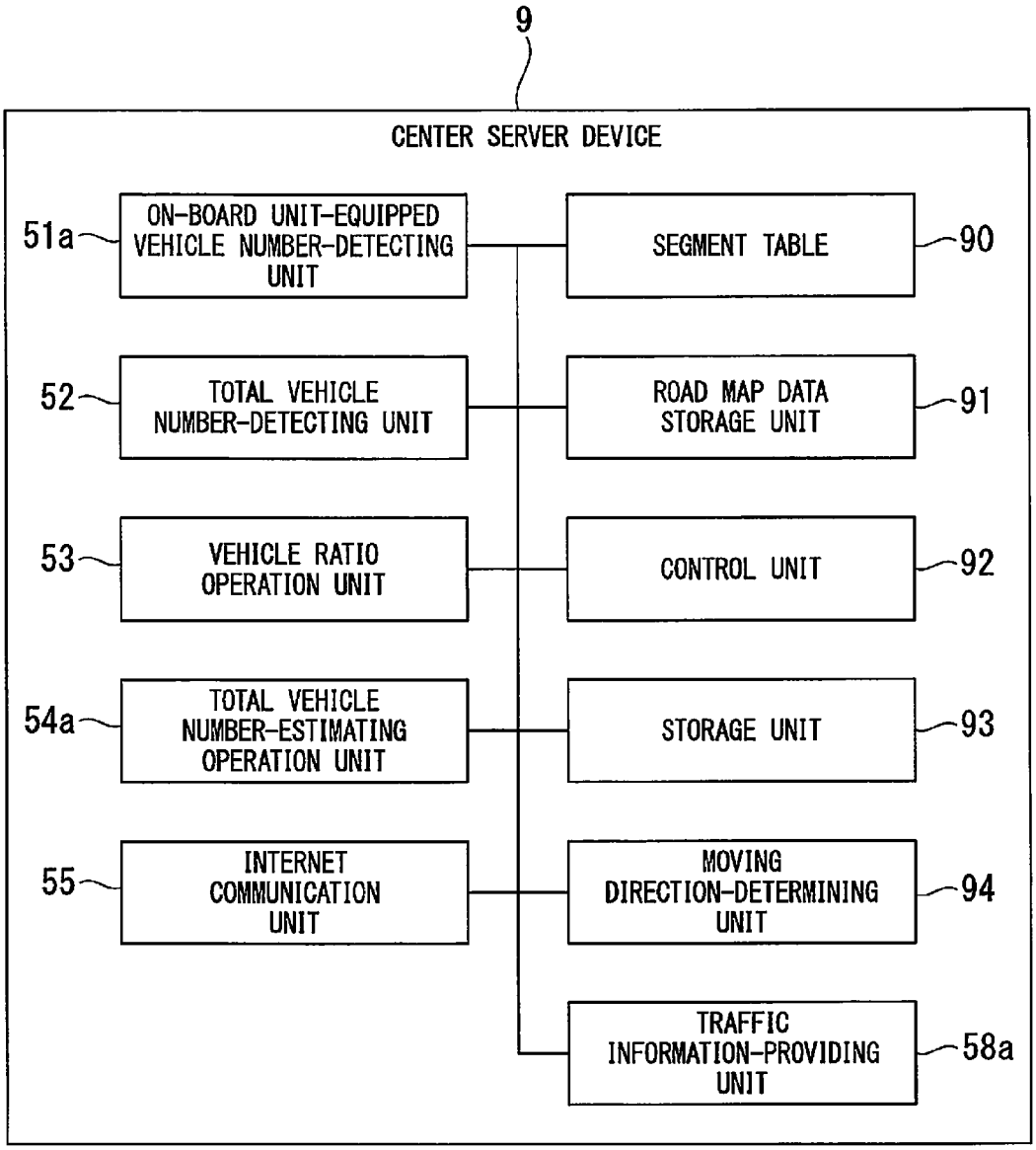
FIG. 18 is a block diagram illustrating an internal configuration of a center server device according to the second embodiment.

FIG. 18 is a block diagram illustrating an internal configuration of the center server device 9. The same functioning units as in the center server device 5 of the first embodiment are denoted by the same reference numerals, and different configurations will be described below.

In the center server device 9, a control unit 92 performs comprehensive management of, for example, transmission and reception of data of the respective units of the center server device 9.

The control unit 92 receives the moving image file photographed by the vehicle-detecting camera 32 and the photography start and end time information of the moving image which are transmitted by the information-collecting device 3*a*, and writes the received information to be stored in a storage unit 93.

Further, the control unit 92 receives an ID of a newly entered segment, information related to a time, and an on-board unit ID, which are transmitted through the base station device 80 by the on-board unit 7, and writes the received information to be stored in a segment table 90.

The storage unit 93 stores a program or data used in the center server device 5. The storage unit 93 stores the moving image file written by the control unit 92, and stores a table that is used to refer to the moving image files, and has items such as a photography start time and end time of the moving image and a moving image file name as illustrated in FIG. 6B, similarly to the first embodiment.

A road map data storage unit 91 stores the same data as the data stored in the road map data storage unit 71 of the on-board unit 7. The road map data storage unit 91 stores latest data, and the on-board unit 7 downloads the data stored in the road map data storage unit 91 and updates the data of the road map data storage unit 71 as described above.

The segment table 90 is, for example, a table of a format illustrated in FIG. 19, and stores the data received from the on-board unit 7 through the Internet communication unit 55. The segment table 90 initially includes an item of "on-board unit ID," and includes a plurality of sets, each of which includes items of "time" and "Seg (segment)."

A moving direction-determining unit 94 determines a moving direction of the vehicle 8 based on the information stored in the segment table 90.

The on-board unit-equipped vehicle number-detecting unit 51*a* detects the number of vehicles 8 equipped with the on-board unit 7 based on the data stored in the segment table 90.

The total vehicle number-estimating operation unit 54*a* detects the number of vehicles 8 that have entered each segment at an arbitrarily determined time from the segment table 90, and performs an operation of estimating the number of all vehicles located in each segment at the corresponding time based on the ratio calculated by the vehicle ratio operation unit 53.

For example, the traffic information-providing unit 58*a* transmits the information indicating the traffic state calculated by the total vehicle number-estimating operation unit 54*a* to the on-board unit 7 through the Internet communication unit 55.

Next, operations of the information-collecting device 3*a*, the on-board unit 7, and the center server device 9 will be described.

The information-collecting device 3*a* performs the same process as the flowchart of FIG. 9 performed by the vehicle-detecting camera 32, and thus operations of the on-board unit 7 and the center server device 9 that are different from those of the first embodiment will be described below.

[Operation of on-Board Unit]

Figure 20:
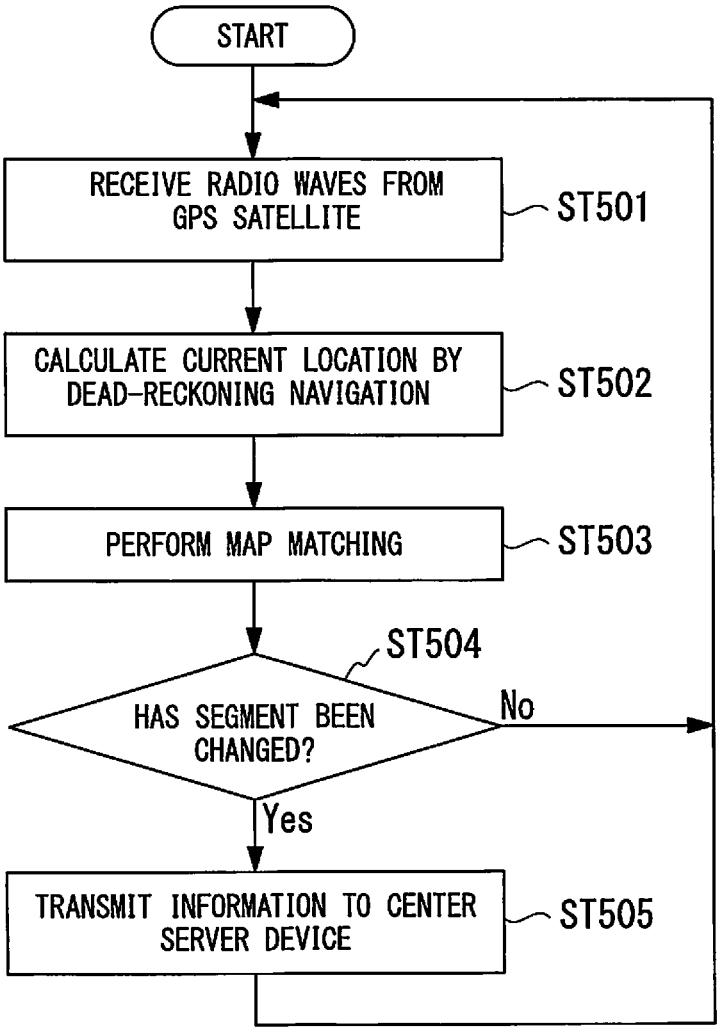
FIG. 20 is a flowchart illustrating an operation of an on-board unit according to the second embodiment.

Next, an operation of the on-board unit 7 will be described with reference to a flowchart of FIG. 20.

(Step ST501)

For example, in FIG. 14, the vehicle 8 is assumed to have traveled in a region to which a segment is not allocated on a road reaching the segment 1 and then entered the segment 1. The GPS receiver 13-1 of the on-board unit 7 of the vehicle 8 receives the radio waves from the GPS satellite 85 with a certain period. The GPS receiver 13-1 measures a latitude and a longitude from information included in the received radio waves, and outputs information of the measured latitude and the longitude, time information included in the received radio waves, and information indicating reliability of the information included in the received radio waves. In the present embodiment, the GPS receiver 13-1 outputs information in which information indicating that the position of the on-board unit 1-1 is a point P1 (latitude $\psi_1$, longitude $\lambda_1$), information indicating that a time at which the position is detected is "08:26," and information indicating reliability "high" are associated.

(Step ST502)

Then, the GPS complementary sensor unit 13-2 performs an operation of estimating the position at which the on-board unit 7 is located at the time "08:26" output by the GPS receiver 13-1 based on a rotation direction of the vehicle 8 obtained from the gyro sensor and information of a velocity of the vehicle 8 obtained from the acceleration sensor. In the present embodiment, the GPS complementary sensor unit 13-2 is assumed to obtain information indicating a point P2 (latitude $\psi_2$, longitude $\lambda_2$) as the position of the on-board unit 1-1 based on the operation result.

Then, the dead-reckoning navigation-processing unit 13-3 calculates a point P3 (latitude $\psi_3$, longitude $\lambda_3$) serving as the position of the on-board unit 7 through a technique illustrated in FIG. 11 using information of the two positions obtained from the GPS receiver 13-1 and the GPS complementary sensor unit 13-2.

Then, the dead-reckoning navigation-processing unit 13-3 writes the information (that is, the information indicating the point P3 (latitude $\psi_3$, longitude $\lambda_3$)) of the calculated position and the time information "08:26" output by the GPS receiver 13-1 to be stored in the table of the storage unit 73 illustrated in FIG. 16, and outputs the stored information to the map matching-processing unit 70. Here, data in which a time is "8:26" in FIG. 16 is assumed to be written data.

(Step ST503)

Then, the map matching-processing unit 70 receives the point P3 (latitude $\psi_3$, longitude $\lambda_3$) serving as the position information and the time information "08:26" from the dead-reckoning navigation-processing unit 13-3, reads information of a previous position of the on-board unit 7 stored in the table of the storage unit 73 and the time information associated with the position information, and obtains trajectories of the vehicle 8, that is, trajectories of the on-board unit 7 that are chronologically lined up.

Figure 21:
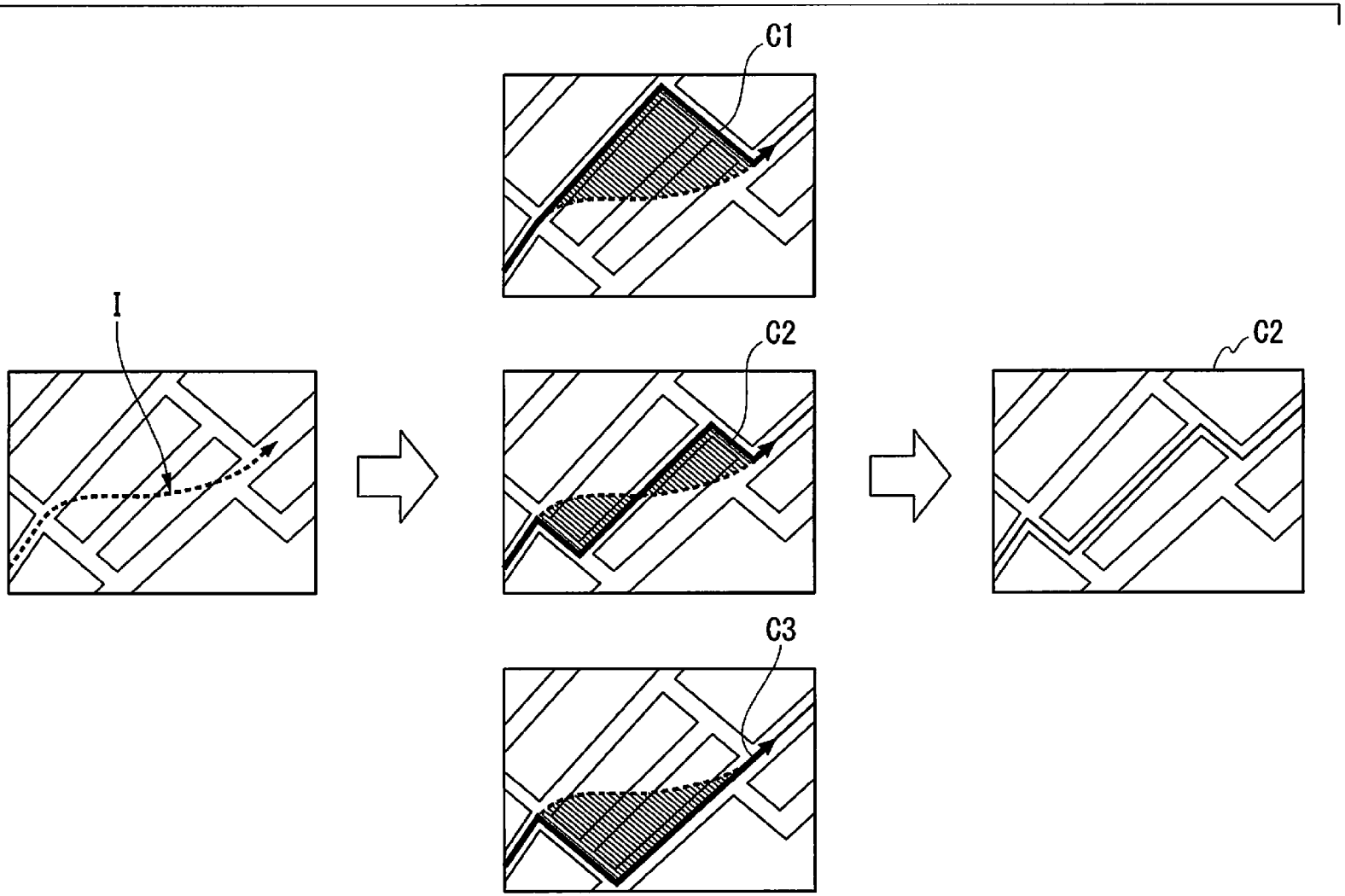
FIG. 21 is a diagram for describing processing of a map matching-processing unit according to the second embodiment.

For example, the trajectory of the on-board unit 7 is assumed to be a trajectory I indicated by a dotted line of FIG. 21. The map matching-processing unit 70 extracts three paths, that is, path candidates C 1, C2, and C3, from the data stored in the road map data storage unit 71 based on the trajectory I as a candidate of a path corresponding to the obtained trajectory I. Then, the map matching-processing unit 70 determines a path candidate having a smallest error amount from an area size (a hatched area of FIG. 21) of an area surrounded by the obtained trajectory I and the paths of the path candidates C 1, C2, and C3. In the present embodiment, the map matching-processing unit 70 determines the path candidate C 2 having the smallest area size (the hatched area of FIG. 21) of the area surrounded by the trajectory I and the path candidates as the path corresponding to the trajectory I of the on-board unit 7.

Then, the map matching-processing unit 70 performs matching of the path C2 determined to be the path of the trajectory I and the information of the latest position, and detects a segment in which the on-board unit 7 is located. The map matching-processing unit 70 associates the segment ID of the detected segment with the position and the time information of the storage unit 73 based on the time information corresponding to the segment ID, records the associated information, and outputs the associated information to the segment change-determining unit 72.

In the present embodiment, the point P3 (latitude $\psi_3$, longitude $\lambda_3$) is assumed to be the position included in the area corresponding to the segment 1. In this case, the map matching-processing unit 70 determines that the on-board unit 1 has entered the segment 1 at a time "08:26." Then, the map matching-processing unit 70 writes "1" in the item of "Seg (segment)" corresponding to the time "08:26." Further, when the segment ID has not been detected, the map matching-processing unit 70 writes "-" in the "Seg" item of the table of the storage unit 73 as described above.

(Step ST504)

Then, the segment change-determining unit 72 receives the segment ID "1" and the time information "08:26" from the map matching-processing unit 70, reads information of a segment ID of an immediately previous time from the table of the storage unit 73, and determines whether or not there is a change in the segment ID.

Here, since the vehicle 8 has traveled in the region to which no segment is allocated and then entered the segment 1, "-" indicating that there is no corresponding segment ID is recorded in the "Seg" item corresponding to an immediately previous time ("08:25" of FIG. 16). The segment change-determining unit 72 determines that there is a change in the segment ID when a new segment ID is detected in a state in which no segment ID is recorded or when a value different from a segment ID of a target time is recorded in a segment ID for an immediately previous time.

On the other hand, the segment change-determining unit 72 determines that there is no change in the segment ID when the segment ID received from the map matching-processing unit 70 is identical to the segment ID for the immediately previous time, and the process returns to step ST501.

(Step ST505)

Then, when it is determined that there is a change in the segment ID, the segment change-determining unit 72 transmits the segment ID "1" received by the map matching-processing unit 70, the time information "08:26" corresponding to the segment ID "1," and the on-board unit ID "12340001" to the center server device 9 through the wide area communication device 12.

Upon receiving data from the on-board unit 7 through the Internet communication unit 55, the control unit 92 of the center server device 9 writes the received data to be stored in the segment table 90 as illustrated in FIG. 19. Here, the on-board unit 7 corresponds to the on-board unit ID "12340001," "08:26" is written in an item of "time 1" of a row of the on-board unit ID "12340001," and "1" indicating the segment 1 is written in the corresponding item of "Seg."

In FIG. 14, as the vehicle 8 moves forward, the on-board unit 7 writes data in the table of the storage unit 73 each time the position is measured. Then, when the segment change-determining unit 72 determines that there is a change in the segment ID, the on-board unit 7 transmits data to the center server device 9, and the data is written in the segment table 90 of the center server device 9.

As the on-board unit 7 moves forward in this way, for example, in the order of the segments 1, 2, 4, and 6, the segment ID for the immediately previous time and the segment ID for the target time are changed. In this case, the segment change-determining unit 72 determines that the segment has been changed in step ST504, and transmits information in which the segment ID received from the map matching-processing unit 70, the time information corresponding to the segment ID, and the on-board unit ID "12340001" are associated with one another to the center server device 9. The center server device 9 writes the received information to the segment table 90. Specifically, the center server device 9 records data illustrated in the row of the on-board unit ID "12340001" of FIG. 19 in the segment table 90.

Then, when the vehicle 8 leaves the segment 6, since the corresponding segment ID is not detected in the process of step ST503, the map matching-processing unit 70 writes "-" indicating that there is no corresponding segment ID as in the "Seg" item corresponding to an item in which a time is "09:23" in the storage unit 73 of the on-board unit 7.

Then, even when a state in which there is a segment ID is changed to a state in which there is no segment ID is performed, the change-determining unit 72 determines that a segment has been changed in step ST504, and transmits data to the center server device 9. The center server device 9 writes "-" indicating a state in which there is no corresponding segment ID as in the "Seg" item of "time 5" of FIG. 19 in the segment table 90. When "-" is written in the "Seg" item of the segment table 90, it indicates that the on-board unit 7 has left a segment in which the on-board unit 7 was located until an immediately previous time.

As described above, when the segment change-determining unit 72 determines that the segment ID has been changed, the on-board unit 7 according to the present embodiment associates the segment ID in which the on-board unit 7 is located with a time at which the on-board unit 7 was first located in the segment indicated by the segment ID, and transmits the associated information to the center server device 9. Thus, the number of transmissions can be reduced to be lower than when both the time and position information illustrated in FIG. 16 are transmitted to the center server device 9.

[Operation of Center Server Device]

Next, an operation of the center server device 9 will be described with reference to FIGS. 22 to 25.

Figure 22:
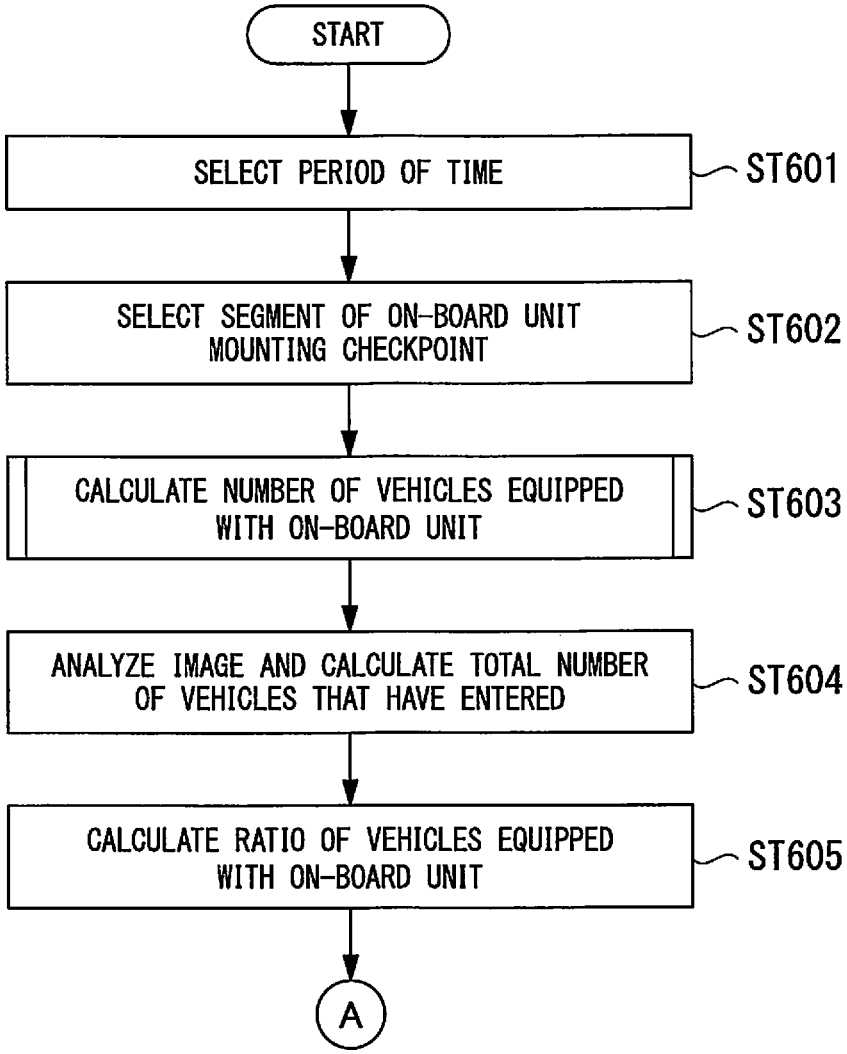
FIG. 22 is a (first) flowchart illustrating an operation of a center server device according to the second embodiment.
Figure 23:
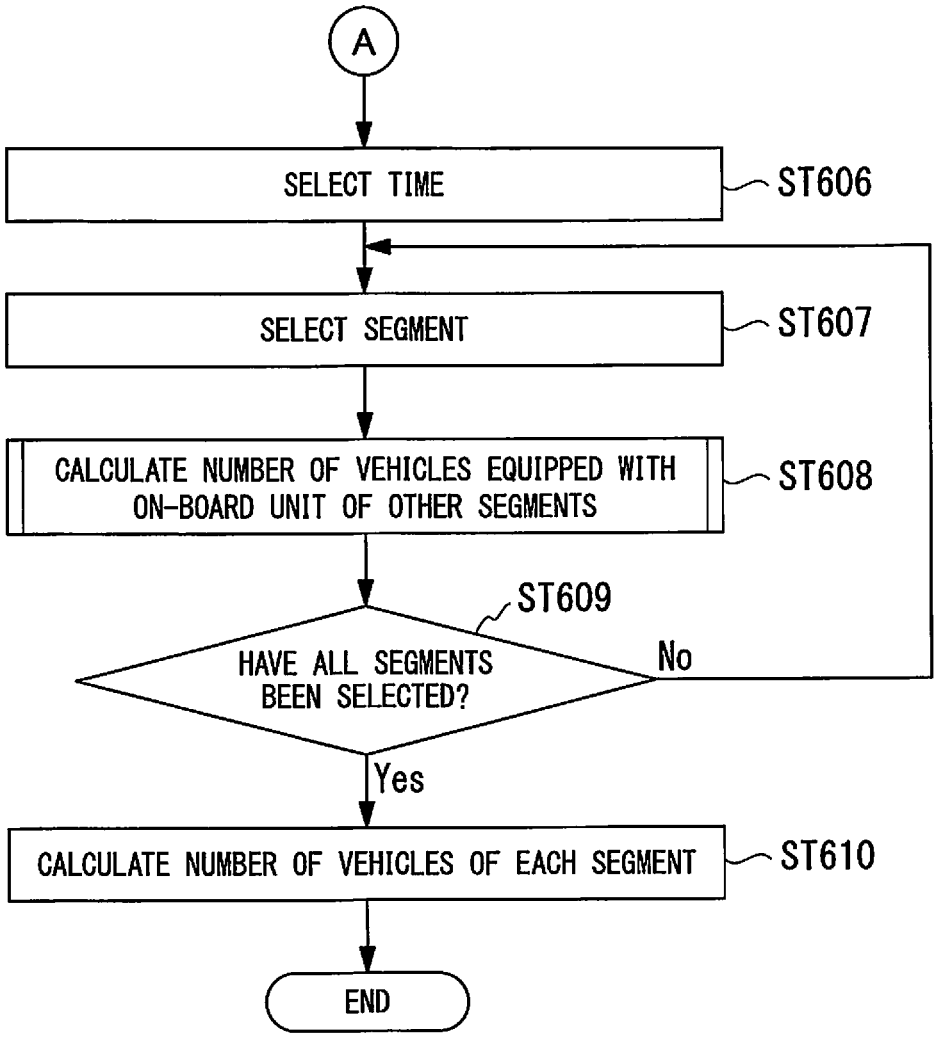
FIG. 23 is a (second) flowchart illustrating an operation of a center server device according to the second embodiment.
Figure 24:
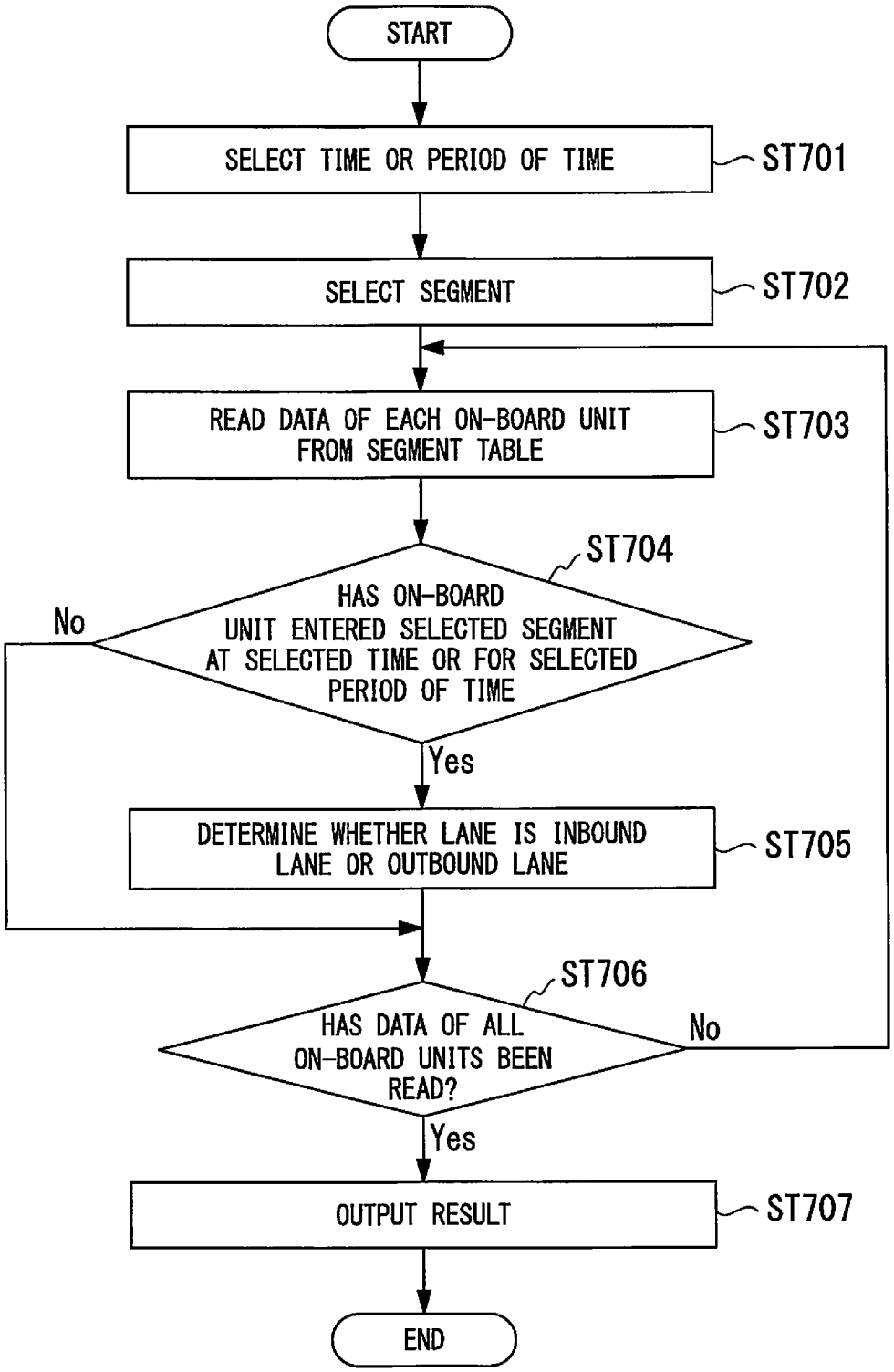
FIG. 24 is a (third) flowchart illustrating an operation of a center server device according to the second embodiment.

FIGS. 22 and 23 illustrate a series of processes connected by a reference symbol A, and FIG. 24 illustrates a sub routine called from step ST603 and step ST608.

(Step ST601)

First, the on-board unit-equipped vehicle number-detecting unit 51*a* of the center server device 5 selects a target time at which the on-board unit mounting rate is calculated. Similarly to the first embodiment, in this example, 9:00 to 9:10 is assumed to be selected based on a photography period of time of a moving image.

(Step ST602)

The on-board unit-equipped vehicle number-detecting unit 51*a* selects a segment of the on-board unit mounting checkpoint at which the information-collecting device 3*a* is installed. Here, the segment 4 is selected as illustrated in FIG. 14.

(Step ST603)

The on-board unit-equipped vehicle number-detecting unit 51*a* calls the sub routine illustrated in FIG. 24 in order to detect the number of vehicles 8 that have entered the inbound lane of the segment 4 from 9:00 to 9:10.

Figure 25:
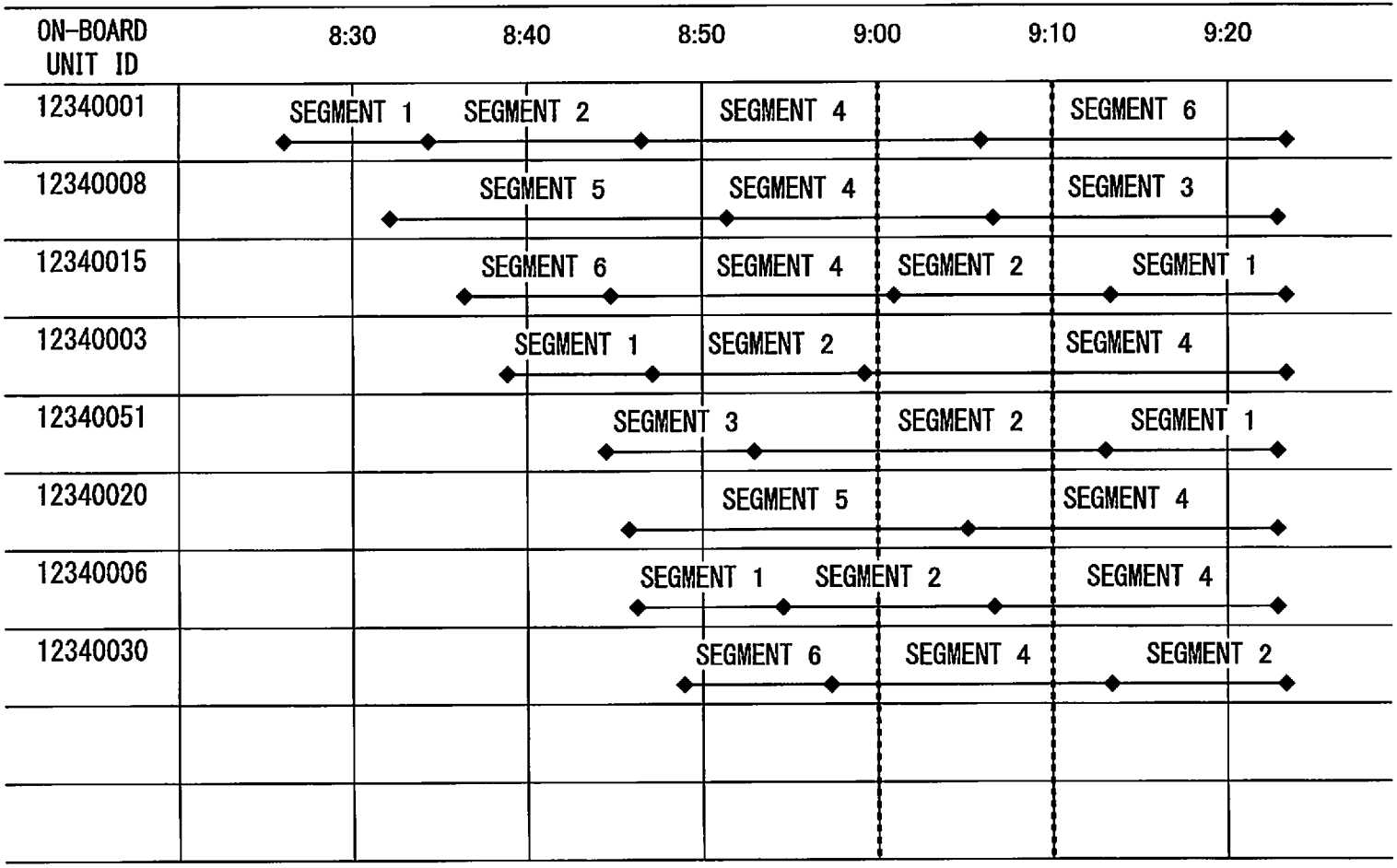
FIG. 25 is a diagram for describing a configuration of data stored in a segment table according to the second embodiment.

FIG. 25 is a diagram illustrating the data stored in the segment table 90 illustrated in FIG. 19 so that the data is easily understood visually. For example, FIG. 25 illustrates that the on-board unit 1 having the on-board unit ID "12340001" entered the segment 1 at 8:26, entered the segment 2 at 8:34, entered the segment 4 at 8:46, entered the segment 6 at 9:06, and left the segment 6 at 9:23.

Here, an example of a processing flow of the sub routine will be described with reference to FIG. 24.

(Step ST701)

The on-board unit-equipped vehicle number-detecting unit 51*a* selects a time or a period of time serving as a target in order to detect the number of vehicles 8 located in any one segment at a certain time or during a certain period of time from the segment table 90.

Here, since a period of time of 9:00 to 9:10 is already selected in the process of step ST601 of the main routine, the same period of time of 9:00 to 9:10 is selected.

(Step ST702)

Then, the on-board unit-equipped vehicle number-detecting unit 51*a* selects a target segment. Since the segment is already selected in the process of step ST602 of the main routine, the segment 4 is selected.

(Step ST703)

Then, the on-board unit-equipped vehicle number-detecting unit 51*a* reads the segment ID associated with the selected time zone (9:00 to 9:10) from the segment table 90 for each on-board unit 7.

(Step ST704)

Then, the on-board unit-equipped vehicle number-detecting unit 51*a* determines whether or not the on-board unit 7 has entered the selected segment 4 for the selected period of time based on the read information.

The on-board unit 7 having the on-board unit ID "12340001" that is initially read entered the segment 4 at 8:46 and left the segment 4 at 9:06. Thus, the on-board unit-equipped vehicle number-detecting unit 51*a* determines that the on-board unit 7 having the on-board unit ID "12340001" has entered the segment 4.

(Step ST705)

When the on-board unit 7 of the target is determined to have entered the segment 4 from 9:00 to 9:10, the on-board unit-equipped vehicle number-detecting unit 51*a* causes the moving direction-determining unit 94 to determine the moving direction in order to calculate the number of vehicles 8 that have entered the inbound lane that is regarded as the photography target by the vehicle-detecting camera 32. The on-board unit-equipped vehicle number-detecting unit 51*a* outputs the on-board unit ID "12340001" of the on-board unit 7 of the target and the selected segment ID "4" to the moving direction-determining unit 94.

Then, the moving direction-determining unit 94 reads data corresponding to the on-board unit ID "12340001" output from the on-board unit-equipped vehicle number-detecting unit 51*a* from the segment table 90. The moving direction-determining unit 94 detects an item corresponding to the segment ID "4" output from the on-board unit-equipped vehicle number-detecting unit 51*a* from among the read data, and reads a segment ID of an immediately previous time of the detected item. In the example illustrated in FIG. 19, the moving direction-determining unit 94 reads the segment ID (=2) of an immediately previous time "8:34" of the item of the detected segment ID "4."

Then, the moving direction-determining unit 94 determines the moving direction of the vehicle 2 based on the data indicating the connection relation of the segments stored in the road map data storage unit 91. Here, the moving direction-determining unit 94 detects a path in which the segment ID has changed from 2 to 4 from the road map data storage unit 91, and determines that the detected path is the inbound lane. Then, the on-board unit ID "12340001" and the determination result "inbound lane" are output to the on-board unit-equipped vehicle number-detecting unit 51*a*.

(Step ST706)

On the other hand, when the on-board unit 7 of the target is determined not to have entered the segment 4 from 9:00 to 9:10, the on-board unit-equipped vehicle number-detecting unit 51*a* proceeds to the process of step ST706. The on-board unit-equipped vehicle number-detecting unit 51*a* determines whether or not data of all the on-board units 7 has been read.

Then, when data of any one on-board unit 7 has not been read, the on-board unit-equipped vehicle number-detecting unit 51*a* repeats the process from step ST703.

(Step ST707)

On the other hand, when data of all the on-board units 7 has been read, the on-board unit-equipped vehicle number-detecting unit 51*a* calculates the number of vehicles 8 that have entered the inbound lane of the segment 4, and outputs the calculated number of vehicles 8 to the vehicle ratio operation unit 53.

In the example illustrated in FIG. 25, the seven on-board units having the on-board unit IDs of 12340001, 12340008, 12340015, 12340003, 12340020, 12340006, and 12340030 have entered the segment 4, and have entered the inbound lane, the outbound lane, the outbound lane, the inbound lane, the outbound lane, the inbound lane, and the outbound lane, respectively. Thus, the on-board unit-equipped vehicle number-detecting unit 51*a* outputs "3" as the number of vehicles that have entered the inbound lane.

Further, in the determination performed by the moving direction-determining unit 94, when there is no item of an immediately previous time, for example, when the segment 1 is selected as the target segment, there is no item of an immediately previous time for the on-board unit 7 having the on-board unit ID of 12340001 as illustrated in FIG. 19. In this case, when the on-board unit 7 has entered the segment 1 in the state in which there is no segment ID, the moving direction-determining unit 94 is able to determine the direction by storing information indicating that the on-board unit 7 has entered the inbound lane in the road map data storage unit 91.

Here, the description of the main process will continue with reference back to FIG. 22.

(Step ST604)

The process of step ST604 performed by the total vehicle number-detecting unit 52 is the same process as step ST403 of FIG. 12, and here, the moving image file of 9:00 to 9:10 is read, and the number of vehicles having traveled past the on-board unit mounting checkpoint is calculated.

(Step ST605)

The process of step ST605 performed by the vehicle ratio operation unit 53 is the same process as step ST404 of FIG. 12, and as a result, the vehicle ratio operation unit 53 calculates the ratio of the number of all vehicles to the number of vehicles equipped with the on-board unit based on the number of vehicles equipped with the on-board unit calculated by the on-board unit-equipped vehicle number-detecting unit 51*a* and the number of vehicles calculated by the total vehicle number-detecting unit 52.

(Step ST606)

Referring to FIG. 23, the total vehicle number-estimating operation unit 54*a* selects a time at which a total number of vehicles in the segment is desired to be checked.

(Step ST607)

The total vehicle number-estimating operation unit 54*a* selects the segments in order starting from the segment 1 in order to detect the number of vehicles 8 that have entered each segment at the corresponding time from the segment table 90.

(Step ST608)

Then, the total vehicle number-estimating operation unit 54*a* selects a time and a segment, and calls the sub routine illustrated in FIG. 24.

By performing the process of steps ST701 to ST707, the total vehicle number-estimating operation unit 54*a* can obtain the number of vehicles 8 that have entered the target segment at the target time.

Further, when the total vehicle number-estimating operation unit 54*a* calls the sub routine of FIG. 24, since information on whether the vehicle has entered the inbound lane or the outbound lane is optional, the process of step ST705 may not be performed.

(Step ST609)

The total vehicle number-estimating operation unit 54*a* determines whether or not all segments have been selected.

When any one segment is not selected, the total vehicle number-estimating operation unit 54*a* repeats the process from step ST607. All segments refer to all segments included in a zone in which the segment 4 is decided to be sample area. In the present embodiment, the zone includes the segments 1 to 6, and the sample area is the segment 4.

(Step ST610)

On the other hand, when all segments have been selected, the total vehicle number-estimating operation unit 54*a* performs an operation of estimating a total number of the vehicles equipped with the on-board unit and a total number of vehicles not equipped with the on-board unit in the respective segments using the calculated number of vehicles of the respective segments and the ratio calculated by the vehicle ratio operation unit 53.

For example, when the operation performed by the vehicle ratio operation unit 53 is an operation of dividing the number of vehicles equipped with the on-board unit by the number of all vehicles, a value indicating an estimation of the number of all vehicles in each segment can be calculated by dividing the number of vehicles of each segment by the value calculated by the vehicle ratio operation unit 53. Then, the total vehicle number-estimating operation unit 54*a* outputs the value indicating the estimated number of all vehicles to the traffic information-providing unit 58*a*, and the traffic information-providing unit 58*a* may provide this value by transmitting this value to the on-board unit 7 without change as information indicating the degree of congestion or may provide image information that is illustrated based on this value so that a congested segment is easily understood.

Through the configuration of the second embodiment, the accurate number of vehicles can be obtained in view of the number of vehicles not equipped with the on-board unit as well as the vehicles equipped with the on-board unit. In the configuration of the first embodiment, the number of all vehicles is estimated in a unit of meshes having a certain area size, whereas in the configuration of the second embodiment, the number of all vehicles is estimated for each segment obtained by dividing a road. Thus, according to the configuration of the second embodiment, it is possible to obtain the number of vehicles passing through the road more accurately and obtain more detailed information indicating the degree of congestion.

Further, in the second embodiment, similarly to the first embodiment, one information-collecting device 3*a* collects information of the number of vehicles equipped with the on-board unit 7 and the number of all passing vehicles in a limited range such as one segment. Then, the center server device 9 performs an operation of estimating the number of all vehicles of the other segments using the information collected by the information-collecting device 3*a*. Thus, it is unnecessary to install a device that detects the number of vehicles in all segments, and it is possible to reduce a system installation cost.

Further, in the second embodiment, similarly to the first embodiment, the information-collecting device 3*a* is installed at one on-board unit mounting checkpoint, but when the ratio of the number of all vehicles to the number of vehicles equipped with the on-board unit differs depending on an area, the information-collecting device 3*a* may be installed in a plurality of segments.

Further, in the example of the second embodiment, the inbound lane of the segment 4 is set as the target, but the ratio may be obtained such that the two vehicle-detecting cameras 32 are installed, and the outbound lane of the segment 4 is also included in the target. In this case, the center server device 9 detects the vehicles 8 equipped with the on-board unit 7 in the inbound lane and the outbound lane through the process of step ST103.

Further, the ratio may be obtained such that a segment of a relatively short distance is set, both the inbound lane and the outbound lane are photographed by one vehicle-detecting camera 32, and the number of vehicles traveling on each of the inbound lane and the outbound lane is detected based on the photographed image.

Through this technique, when a plurality of values indicating the number of vehicles equipped with the on-board unit of each point calculated by the on-board unit-equipped vehicle number-detecting unit 51*a* and a plurality of values indicating the number of all vehicles of each point calculated by the total vehicle number-detecting unit 52 are obtained, the respective sum values may be calculated, and the ratio may be calculated based on the sum values, similarly to the first embodiment. Further, an average value of the number of vehicles equipped with the on-board unit and an average value of the number of all vehicles may be calculated, and the ratio may be calculated based on the values. Furthermore, when there is a variation in each point, the ratio may be calculated in view of weighting depending on a distribution thereof.

Further, in the second embodiment, it is possible to calculate the number of vehicles 8 equipped with the on-board unit 7 passing through the on-board unit mounting checkpoint using the information stored in the segment table 90 of the center server device 9 and thus reduce the cost for the wireless communication antenna 31 and the wireless communication unit 33, compared to the first embodiment.

Here, the present invention is not limited to the above embodiments. In the configuration of the second embodiment, similarly to the first embodiment, the information-collecting device 3*a* may be equipped with the wireless communication antenna and the wireless communication unit, and the number of vehicles 8 equipped with the on-board unit 7 passing through the on-board unit mounting checkpoint may be calculated through the same technique as in the first embodiment.

Further, in Embodiments 1 and 2, the information-collecting device 3 and the information-collecting device 3*a* performs the operation for a certain period of time at certain intervals, but the present invention is not limited to this configuration, and the operation may be continuously performed. Furthermore, an image photographed by the vehicle-detecting cameras 32 of the information-collecting device 3 and the information-collecting device 3*a* may be a plurality of still images obtained by performing the photography only when a vehicle passes through rather than a moving image.

Further, in the first embodiment, the number of vehicles equipped with the on-board unit is calculated through the on-board unit-equipped vehicle number-detecting unit 51 with which the center server device 5 is equipped, but the information-collecting device 3 may be equipped with the on-board unit-equipped vehicle number-detecting unit 51.

Further, in Embodiments 1 and 2, the number of all vehicles is calculated through the total vehicle number-detecting unit 52 with which the center server devices 5 and 9 are equipped, but the information-collecting device 3 and 3*a* may equip with this configuration.

Further, in Embodiments 1 and 2, the ratio of the number of all vehicles to the number of vehicles equipped with the on-board unit is obtained by dividing the number of vehicles equipped with the on-board unit by the number of all vehicles, but the present invention is not limited to this configuration. For example, the ratio may be obtained by dividing the number of all vehicles by the number of vehicles equipped with the on-board unit, or the ratio of the number of all vehicles to the number of vehicles not equipped with the on-board unit or the ratio of the number of vehicles not equipped with the on-board unit to the number of all vehicles may be obtained.

Further, the information-collecting devices 3 and 3*a* according to Embodiments 1 and 2 have the configuration in which the photography is performed by the vehicle-detecting camera 32, and the number of vehicles is detected by analyzing the photographed image, but the detecting of the number of vehicles is not limited to the technique based on the image analysis. A tread board may be installed on a point over which vehicles pass, and the number of traveling vehicles may be counted using the tread board, or the number of entering vehicles may be counted by an infrared sensor or an ultrasonic sensor.

Further, a program for implementing functions of the respective processing units in the present invention may be recorded in a computer-readable recording medium, and conversion of an assembly program may be performed by reading the program recorded in the recording medium into a computer system and executing the read program.

Here, the "computer system" is assumed to include an operating system (OS), hardware such as a peripheral device, and the like. Further, the "computer system" is assumed to include a WWW system having a home page provision environment (or display environment). Furthermore, the "computer-readable recording medium" refers to a portable medium such as a flexible disk, a magneto optical disc, a ROM, or a CD-ROM or a storage device such as a hard disk with which a computer system is equipped. Moreover, the "computer-readable recording medium" is assumed to include a medium holding a program for a certain period of time such as an internal non-volatile memory (RAM) of a computer system serving as a server or a client when a program is transmitted via a network such as the Internet or a communication line such as a telephone line.

Further, the program may be transmitted from a computer system stored in a device storing the program or the like to another computer system through a transmission medium or transmitted waves in a transmission medium. Here, the "transmission medium" through which the program is transmitted refers to a medium having an information-transmitting function such as a network (a communication network) such as the Internet or a communication line (a communication wire) such as a telephone line. Furthermore, the program may be one which implements some of the above-described functions. Moreover, the program may be a so-called differential file (a differential program) that can implement the above-described functions in combination with a program previously stored in a computer system.

INDUSTRIAL APPLICABILITY

According to the traffic information processing system, the server device, the traffic information processing method, and the program, it is possible to obtain the relatively accurate number of vehicles present in a certain zone in which the number of vehicles not equipped with the on-board unit as well as the number of vehicles equipped with the on-board unit is considered.

REFERENCE SIGNS LIST

1 On-board unit
10 Power circuit
11 Internal battery
12 Wide area communication device
13 Position-detecting unit
13-1 GPS receiver
13-2 GPS complementary sensor unit
13-3 Dead-reckoning navigation-processing unit
14 Mesh code storage unit
15 Mesh code-acquiring unit
16 Mesh code change-determining unit
17 Display unit
18 Alarm unit
19 Storage unit
20 Control unit
3 Information-collecting device
31 Wireless communication antenna
32 Vehicle-detecting camera
33 Wireless communication unit
34 Camera control unit
35 Clock unit
36 Internet communication unit
37 Control unit
38 Storage unit
5 Center server device
51 On-board unit-equipped vehicle number-detecting unit
52 Total vehicle number-detecting unit
53 Vehicle ratio operation unit
54 Total vehicle number-estimating operation unit
55 Internet communication unit
56 Mesh code table
57 Mesh code storage unit
58 Traffic information-providing unit
59 Storage unit
60 Control unit
2 Vehicle
80 Base station device
85 GPS satellite
100 Traffic information processing system

The invention claimed is:

1. A traffic information processing system, comprising:

an on-board detecting device configured to be installed in a vehicle; and a server device configured to communicate with the on-board detecting device and configured to perform functions of:

counting the number of vehicles equipped with the on-board detecting device entering a sample area, which is part of a plurality of zones divided from a place in which vehicles equipped with the on-board detecting device and vehicles not equipped with the on-board detecting device travel, based on information received from the on-board detecting device;

counting the total number of vehicles entering the sample area, the total number of vehicles entering the sample area including vehicles equipped with the on-board detecting device and vehicles not equipped with the on-board detecting device;

calculating a ratio of the number of vehicles equipped with the on-board detecting device with respect to the total numbers of vehicles in the sample area, based on the number of vehicles equipped with the on-board detecting device entering the sample area and the total number of vehicles entering the sample area; and calculating a total number of vehicles including vehicles equipped with the on-board detecting device and vehicles not equipped with the on-board detecting device in the zone based on the number of vehicles equipped with the on-board detecting device entering the zone and the ratio of the number of vehicles equipped with the on-board detecting device in the sample area, wherein the on-board detecting device reports traffic information according to the total number of vehicles in the zone.

2. The traffic information processing system according to claim 1, wherein the server device calculates the number of vehicles equipped with the on-board detecting device entering the zone based on information indicating a zone in which the on-board detecting device is located among the plurality of zones that are sequentially detected based on information indicating a position of the on-board detecting device.

3. The traffic information processing system according to claim 1, further, comprising, an information-collecting device that is connected with a camera, wherein the information-collecting device acquires an image obtained by photographing the vehicle entering the sample area by the camera, and the server device analyzes the acquired image photographed by the camera, and counts the total number of vehicles entering the sample area.

4. The traffic information processing system according to claim 3, wherein the information-collecting device includes a wireless communication antenna, the on-board detecting device receives a radio signal transmitted from the wireless communication antenna, and responds, the server device counts the number of on-board detecting devices that have responded, and calculates the number of vehicles equipped with the on-board detecting device entering the sample area.

5. The traffic information processing system according to claim 1, wherein each zone contains at least one segment which represents a section of a road, and a predetermined segment is the sample area, and the server device calculates the number of vehicles, which is equipped with the on-board detecting device entering the segment serving as the sample area among the vehicles which is equipped with the on-board detecting device and the vehicles which is not equipped with the on-board detecting device that travel in a place divided into a plurality of segments, based on information indicating a segment in which the on-board detecting device is located among the plurality of segments that are sequentially detected based on the information indicating the position of the on-board detecting device.

6. The traffic information processing system according to claim 1, wherein there are a plurality of sample areas, the server device counts the number of vehicles equipped with the on-board detecting device entering the sample area in a unit of sample areas, the server device counts the total number of vehicles entering the sample area in a unit of sample areas, and the server device calculates the value related to the ratio which is based on the number of vehicles equipped with the on-board detecting device in the sample areas and the total number of vehicles in the sample area.

7. The traffic information processing system according to claim 6, wherein a value indicating a weighting on the number of vehicles present is allocated to the plurality of sample areas in advance, and the server device calculates the value related to the ratio which is based on the number of vehicles equipped with the on-board detecting device in the sample area, the total number of vehicles in the sample area, and the value indicating the weighting of each sample area.

8. A server device, comprising:

a computer configured to perform functions of:

counting the number of vehicles equipped with an on-board detecting device entering a sample area, which is part of a plurality of zones divided from a place in which vehicles equipped with the on-board detecting device and vehicles not equipped with the on-board detecting device travel, based on information received from the on-board detecting device;

counting the total number of vehicles entering the sample area, the total number of vehicles entering the sample area including vehicles equipped with the on-board detecting device and vehicles not equipped with the on-board detecting device;

calculating a ratio of the number of vehicles equipped with the on-board detecting device with respect to the total numbers of vehicles in the sample area, based on the number of vehicles equipped with the on-board entering the sample area and the total number of vehicles entering the sample area;

calculating a total number of vehicles including vehicles equipped with the on-board detecting device and vehicles not equipped with the on-board detecting device in the zone based on the number of vehicles equipped with the on-board detecting device entering the zone and the ratio of the number of vehicles equipped with the on-board detecting device in the sample area; and generating image information as traffic information according to the total number of vehicles in the zone and sending the traffic information to the on-board detecting device.

9. A traffic information-processing method, comprising:

counting the number of vehicles equipped with an on-board detecting device entering a sample area, which is part of a plurality of zones divided from a place in which vehicles equipped with the on-board detecting device and vehicles not equipped with the on-board detecting device travel, based on information received from the on-board detecting device;

counting the total number of vehicles entering the sample area, the total number of vehicles entering the sample area including vehicles equipped with the on-board detecting device and vehicles not equipped with the on-board detecting device;

calculating a ratio of the number of vehicles equipped with the on-board detecting device with respect to the total numbers of vehicles in the sample area, based on the number of vehicles equipped with the on-board detecting device entering the sample area and the total number of vehicles entering the sample area;

calculating a total number of vehicles including vehicles equipped with the on-board detecting device and vehicles not equipped with the on-board detecting device in the zone based on the number of vehicles equipped with the on-board detecting device entering the zone and the ratio of the number of vehicles equipped with the on-board detecting device in the sample area; and reporting traffic information according to the total number of vehicles in the zone.

10. A non-transitory computer readable medium which stores a program causing a computer to perform functions of:

counting the number of vehicles equipped with an on-board detecting device entering a sample area, which is part of a plurality of zones divided from a place in which vehicles equipped with the on-board detecting device and vehicles not equipped with the on-board detecting device travel, based on information received from the on-board detecting device;

counting the total number of vehicles entering the sample area, the total numbers of vehicles entering the sample area including vehicles equipped with the on-board detecting device and vehicles not equipped with the on-board detecting device;

calculating a ratio of the number of vehicles equipped with the on-board detecting device with respect to the total numbers of vehicles in the sample area, based on the number of vehicles equipped with the on-board detecting device entering the sample area and the total number of vehicles entering the sample area;

calculating a total number of vehicles including vehicles equipped with the on-board detecting device and vehicles not equipped with the on-board detecting device in the zone based on the number of vehicles equipped with the on-board detecting device entering the zone the ratio of the number of vehicles equipped with the on-board detecting device in the sample area; and generating image information as traffic information according to the total number of vehicles in the zone and sending the traffic information to the on-board detecting device.

* * * * *